US008146295B2

(12) United States Patent
Kibbel et al.

(10) Patent No.: US 8,146,295 B2
(45) Date of Patent: Apr. 3, 2012

(54) Z-BAR EXTENSION MEMBER AND ASSEMBLY

(75) Inventors: Keith Kibbel, Forest Lake, MN (US); Kelly Nordgaard, Gary, SD (US)

(73) Assignee: Larson Manufacturing Company of South Dakota, Inc., Brookings, SD (US)

( * ) Notice: Subject to any disclaimer, the term of this patent is extended or adjusted under 35 U.S.C. 154(b) by 891 days.

(21) Appl. No.: 12/002,750

(22) Filed: Dec. 18, 2007

(65) Prior Publication Data

US 2008/0163554 A1 Jul. 10, 2008

Related U.S. Application Data

(60) Provisional application No. 60/875,480, filed on Dec. 18, 2006.

(51) Int. Cl.
*E06B 1/04* (2006.01)

(52) U.S. Cl. ..... 49/504; 52/632; 52/846

(58) Field of Classification Search ..... 49/504, 49/505; 52/204.1, 217, 212, 210, 205.56, 52/632 X, 846 X; D25/61, 164
See application file for complete search history.

(56) References Cited

U.S. PATENT DOCUMENTS

| | | | | | |
|---|---|---|---|---|---|
| 1,046,666 | A | * | 12/1912 | Smith | 52/217 |
| 2,739,674 | A | * | 3/1956 | Casebolt | 49/505 |
| 3,002,592 | A | * | 10/1961 | Quinn | 49/399 |
| 3,393,471 | A | * | 7/1968 | Skowlund et al. | 49/475.1 |
| 3,553,891 | A | * | 1/1971 | Casebolt et al. | 49/505 |
| 3,584,416 | A | * | 6/1971 | Baumgartel | 49/380 |
| 3,710,839 | A | | 1/1973 | Andres | |
| 3,889,423 | A | * | 6/1975 | Begin | 49/504 |
| 4,077,160 | A | | 3/1978 | Stewart | |
| 4,106,238 | A | * | 8/1978 | Bonello | 49/382 |
| 4,328,644 | A | * | 5/1982 | Scott et al. | 49/501 |
| 4,330,972 | A | * | 5/1982 | Sailor | 52/211 |
| D271,055 | S | * | 10/1983 | Cascone et al. | D25/119 |
| 4,430,830 | A | * | 2/1984 | Sailor | 52/211 |
| 4,531,337 | A | * | 7/1985 | Holdiman | 52/217 |
| 4,754,524 | A | | 7/1988 | Bullock et al. | |
| 4,888,924 | A | * | 12/1989 | Grisham et al. | 52/217 |

(Continued)

FOREIGN PATENT DOCUMENTS

GB 2059487 A * 4/1981

(Continued)

OTHER PUBLICATIONS

Image File Wrapper for U.S. Publication No. 2009/0126278.

(Continued)

*Primary Examiner* — Jerry Redman
(74) *Attorney, Agent, or Firm* — Patterson Thuente Christensen Pedersen P.A.

(57) ABSTRACT

An apparatus and method of assembling and using a z-bar extension member for a door installation that negates the need for trimming the assembly. The apparatus includes an exterior z-bar member having an exterior barrel portion and an interior z-bar member having an interior barrel portion. The interior barrel portion is slidably or snappingly engaged within the exterior barrel portion. Mating structures may be included on the cooperating components to maintain a positional relationship therebetween during assembly. A guard assembly that mounts to the edge of a door or on the end of a door expander to cover the gap between the z-bar and the casing is also disclosed that may be used in conjunction with or as an alternative to the z-bar extension member.

7 Claims, 27 Drawing Sheets

U.S. PATENT DOCUMENTS

| | | | | |
|---|---|---|---|---|
| 5,022,204 | A * | 6/1991 | Anderson | 52/211 |
| 5,187,898 | A | 2/1993 | McKann | |
| 5,216,839 | A * | 6/1993 | Woodruff | 49/382 |
| 5,423,149 | A * | 6/1995 | Herbst | 49/382 |
| 5,483,771 | A | 1/1996 | Herbst | |
| 5,775,400 | A | 7/1998 | Wilkinson | |
| 5,860,250 | A | 1/1999 | Hill et al. | |
| 6,088,966 | A | 7/2000 | Kenkel | |
| 6,401,402 | B1 * | 6/2002 | Williams | 52/58 |
| D467,007 | S | 12/2002 | Daudet et al. | |
| D595,866 | S | 7/2009 | Kibbel et al. | |
| 7,661,226 | B2 * | 2/2010 | Kibbel et al. | 49/382 |
| 2004/0187427 | A1 | 9/2004 | Skublevitz | |
| 2006/0150524 | A1 | 7/2006 | Kibbel et al. | |
| 2007/0209299 | A1 | 9/2007 | El Etel | |
| 2009/0126278 | A1 | 5/2009 | Dixon | |

FOREIGN PATENT DOCUMENTS

| | | | |
|---|---|---|---|
| GB | 2087462 | A * | 5/1982 |
| JP | 08121051 | A | 5/1996 |

OTHER PUBLICATIONS

Image File Wrapper for U.S. Design Patent No. D595,866.

* cited by examiner 98
100
66
96
94
88
76
64
74

84
70
60
87
86
104
102

30
32

46
85
34
52

Z-BAR EXTENSION MEMBER AND ASSEMBLY

RELATED APPLICATION

The present application claims the benefit of U.S. Provisional Application No. 60/875,480 filed Dec. 18, 2006, which is incorporated by reference herein in its entirety.

FIELD OF THE INVENTION

The present invention relates to doors. More particularly, the present invention relates to z-bar assemblies for doors.

BACKGROUND OF THE INVENTION

A door assembly, such as a storm door, often involves the use of what is commonly referred to as a "z-bar." The z-bars are typically formed to mount the door assembly to the jambs or exterior trim of the entry door. Normally there are two z-bars in such an installation: a hinge-side z-bar and a latch-side z-bar. There may also be a z-bar extending over the top of the door that serves as or facilitates a drip cap. The hinge-side z-bar is so named because it accommodates hinges for pivotal mounting of the door. The latch-side z-bar is so named because it is located adjacent the latch side of the door and may serve as part of a system to latch the door in a closed position.

Some manufacturers specify a given door assembly to cover a range of door openings. The door is typically equipped with a door expander or spacer that enables adjustment of the length of the door relative to the opening, as well as the adjustment of the orientation of the lower edge of the door to accommodate door sills and/or door casings that may not be true.

It is often desired that the z-bars extend over the entire length of the storm door or entry door jambs for reasons of aesthetics, connectivity and energy conservation. Accordingly, the z-bars are typically sized to operatively match a maximum or fully expanded length of the door.

However, the height of door openings will often vary and will often be less than the full length of traditional z-bars, requiring the installer to trim the ends of the z-bars off. Conventional methods and techniques for trimming z-bars are innately inconvenient and time consuming. In addition, many casings feature a sill having an inclined upper surface that sheds water. The trimmed ends of these traditional z-bars are typically cut to accommodate the incline. A trimming cut that either leaves the z-bar too short or at an improper angle relative to the incline is generally detrimental to the aesthetic and energy conservation qualities of the assembly, and increases the installation time of the door assembly.

Some manufacturers supply z-bars that are intentionally shorter than the minimum length of the door so that z-bar does not have to be cut to fit the height of the door frame during installation. Such an approach is disclosed in U.S. Patent Application Publication No. 2006/0150524 to Kibbel et al. While this approach negates the need for cutting the z-bar to length, it does not address the aforementioned detriments to aesthetics and energy conservation.

A z-bar assembly that avoids the problems that can result from shortened z-bars, and augments a more efficient installation procedure would be welcome.

SUMMARY OF THE INVENTION

Various embodiments of the invention include a z-bar having an extender for adjusting the length of the overall z-bar assembly. The length of the z-bar is generally undersized, with the extender slidably attached to provide a telescoping adjustment to the overall length of the assembly without need for trimming. The extenders may have substantially the same profile as the z-bar to maintain aesthetic appearance and functionality. The various embodiments may be applicable to both hinge-side and latch-side z-bars.

In one embodiment, a door assembly comprises a door casing or frame including a door jamb and a sill, at least one z-bar member mounted to the casing, and a z-bar extension member or extender mounted to the z-bar member and extending beyond the end of the z-bar member. One end of the z-bar assembly may be factory cut or otherwise formed to accommodate sill incline angles standard in the industry.

In another embodiment, the z-bar assembly includes an exterior z-bar member with an exterior barrel portion, and an interior z-bar extension member with an interior barrel portion. The interior barrel portion of the extension member is slidably engaged within the exterior barrel portion of the z-bar member, enabling the extender to selectively extend beyond the end of the exterior z-bar member.

In another embodiment, the z-bar extension member is made of a resilient material and is mounted on the exterior of the z-bar member by snapping engagement over the barrel portion of the z-bar member.

In another embodiment, the z-bar or z-bar extension member may include one or more score lines extending laterally across the z-bar extension member. The z-bar extension member can be snapped off or otherwise truncated at a selected score line to modify the length of the z-bar extension member. The score lines may also serve as a guide for cutting the z-bar or z-bar extension to a unique length between score lines.

In other embodiments, the z-bar extension member includes a base portion on one end. The base portion may be formed integrally with the z-bar extension member, and may define an obtuse angle with respect to the z-bar extension member to substantially match the incline angles of sills standard in the industry.

In certain embodiments, the interior and exterior z-bar members are formed with mating structures such as, but not limited to, projections and apertures or detents and grooves that cooperate to at least temporarily maintain the mated structures in a generally linear positional relationship with respect to each other to assist in the installation and adjustment of the assembly. In other embodiments, structures or cut-away portions may define slots for slidable engagement that imparts a friction between the interior and exterior z-bar members, thereby aiding in holding the adjustment of the length of the assembly.

In some embodiments, the interior z-bar extension member may be sized and configured such that it is under generally constant resistance within the exterior z-bar member, creating friction and restricting, but not prohibiting, movement of the extension member.

An embodiment is also disclosed wherein a guard assembly may be mounted on a vertical edge of the door, the guard assembly having a shield portion that extends at least partially over the z-bar or z-bar assembly. The guard assembly may extend the length of the vertical edge or only a portion thereof to cover at least a corresponding portion of the gap that exists between the vertical edge of the door and the z-bar assembly. The guard assembly may also take the form of an end cap that mounts to and covers an end of the door expander, to retain insulation within the door expander and/or to prevent debris such as dirt and salt from entering the door expander.

DETAILED DESCRIPTION

Figure 1:
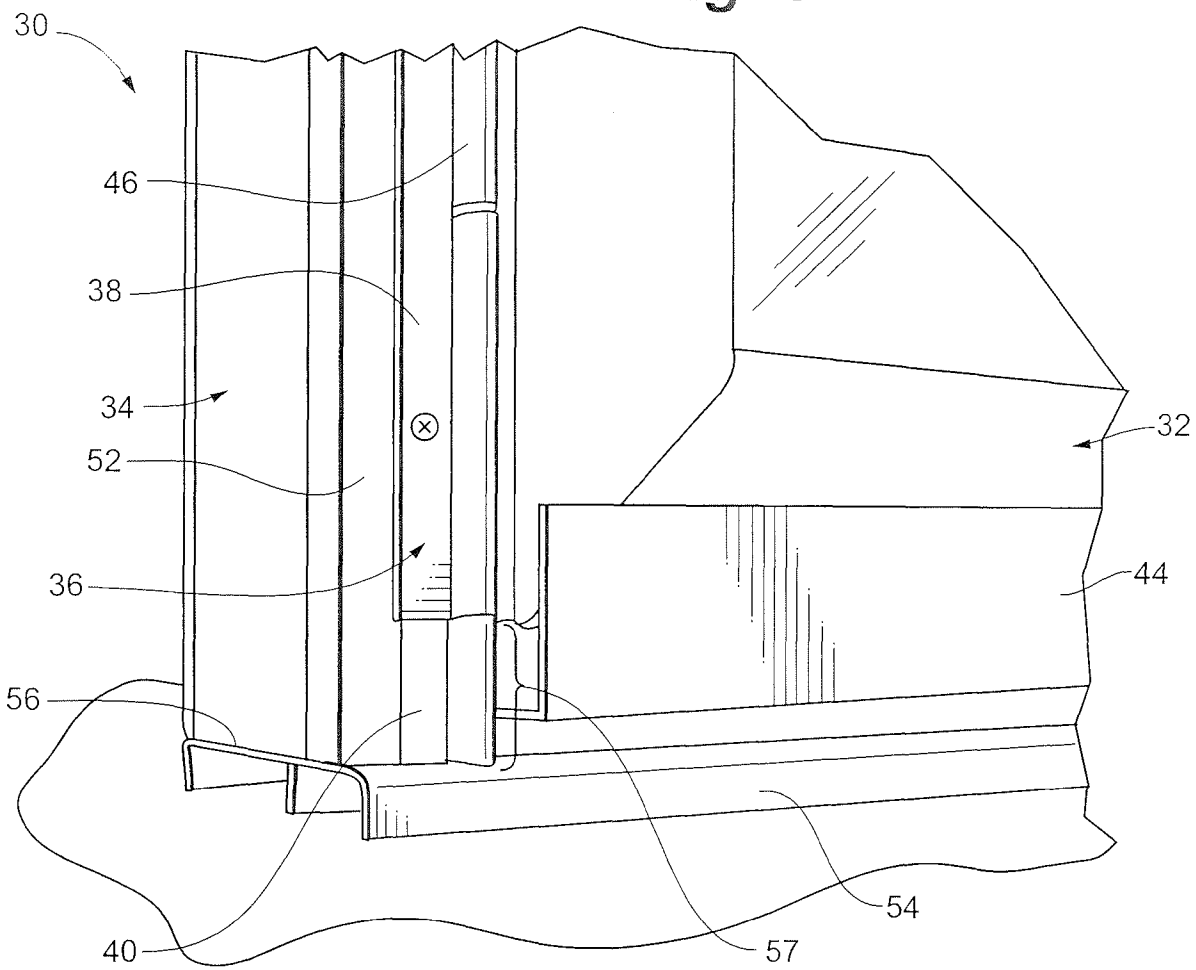
FIGS. 1 through 3 are partial perspective views of a door assembly in an embodiment of the invention.
Figure 2:
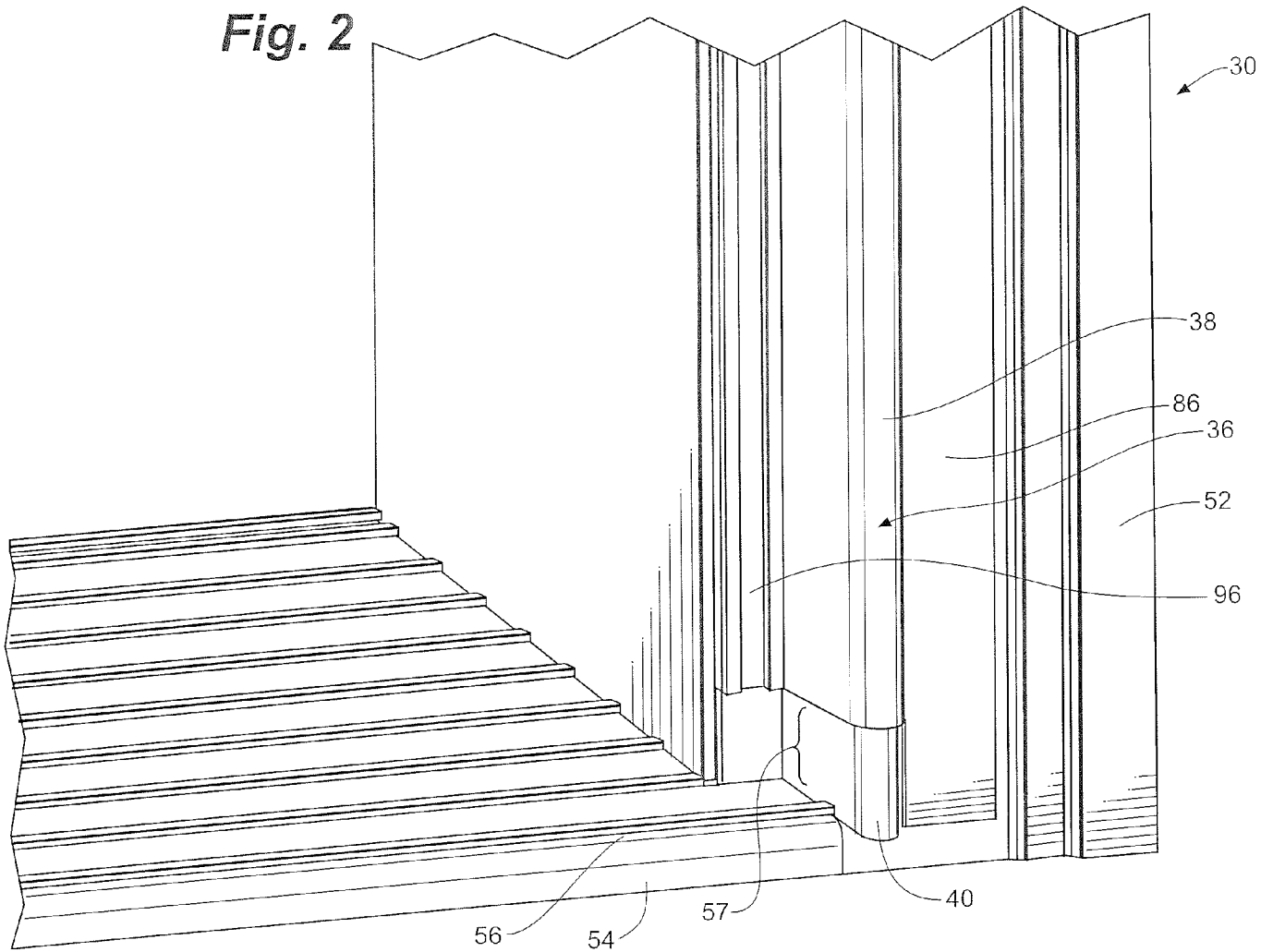
Figure 3:
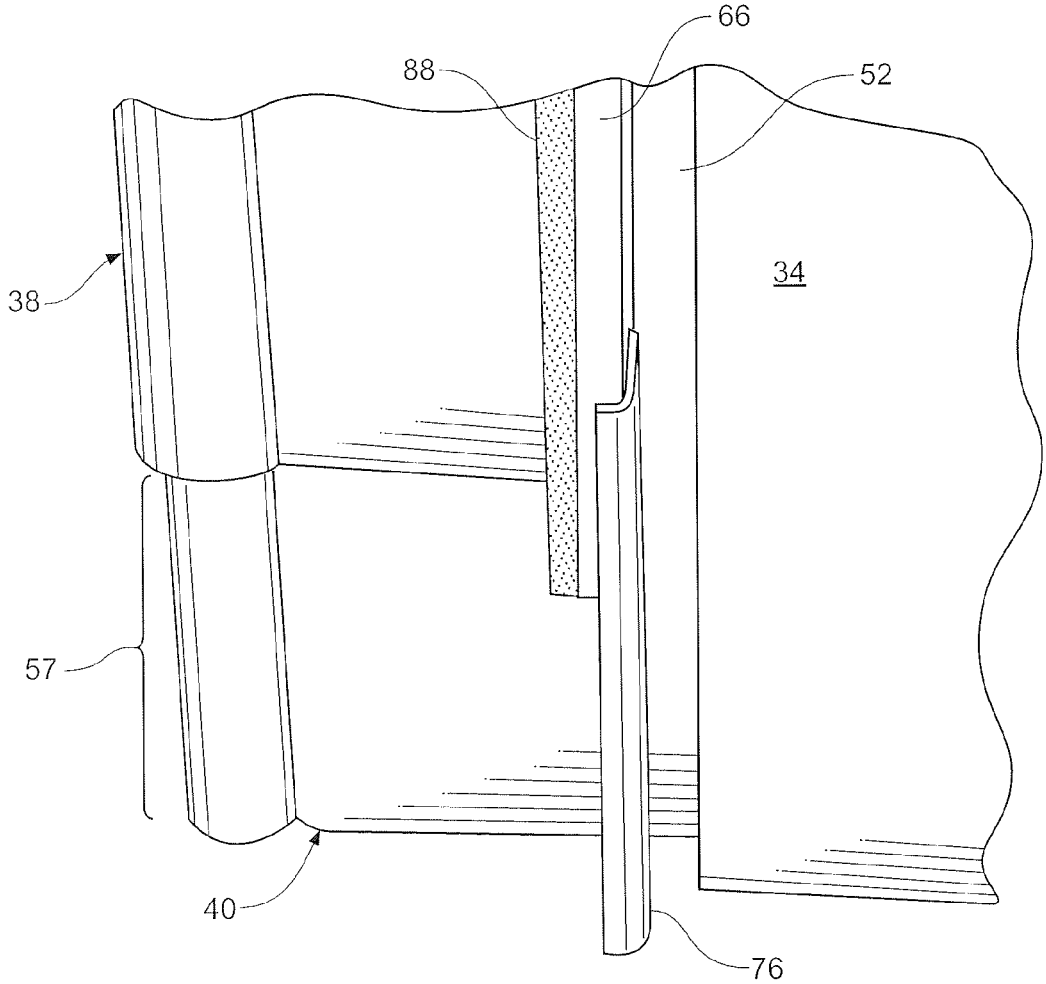
Figure 4:
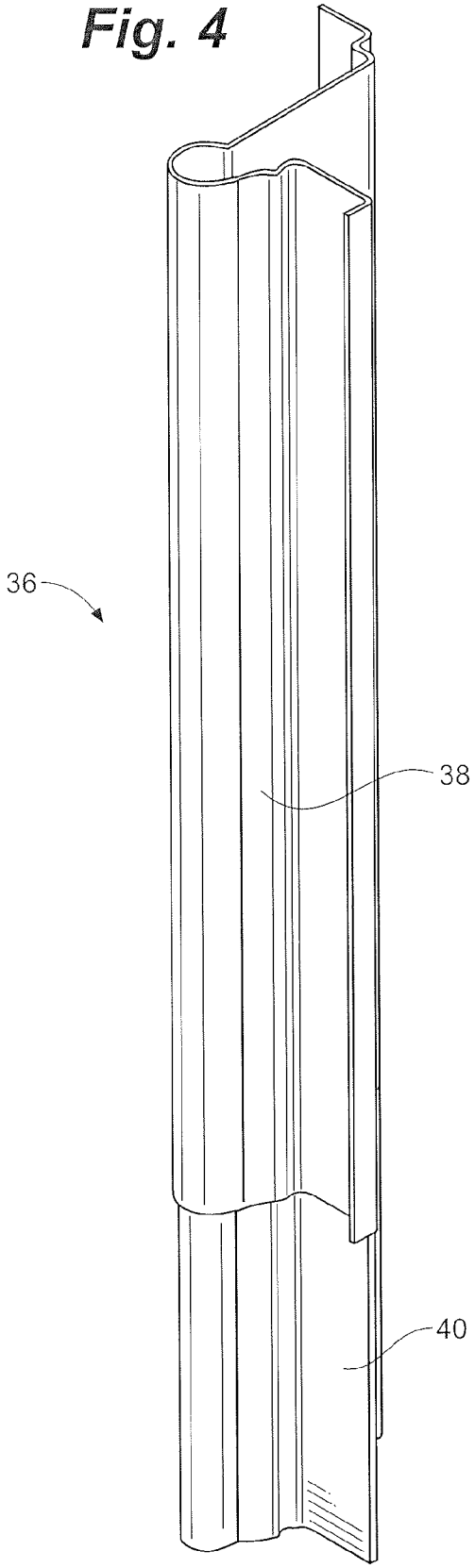
FIG. 4 is a perspective isolation view of the extended z-bar assembly of FIG. 2.
Figure 5:
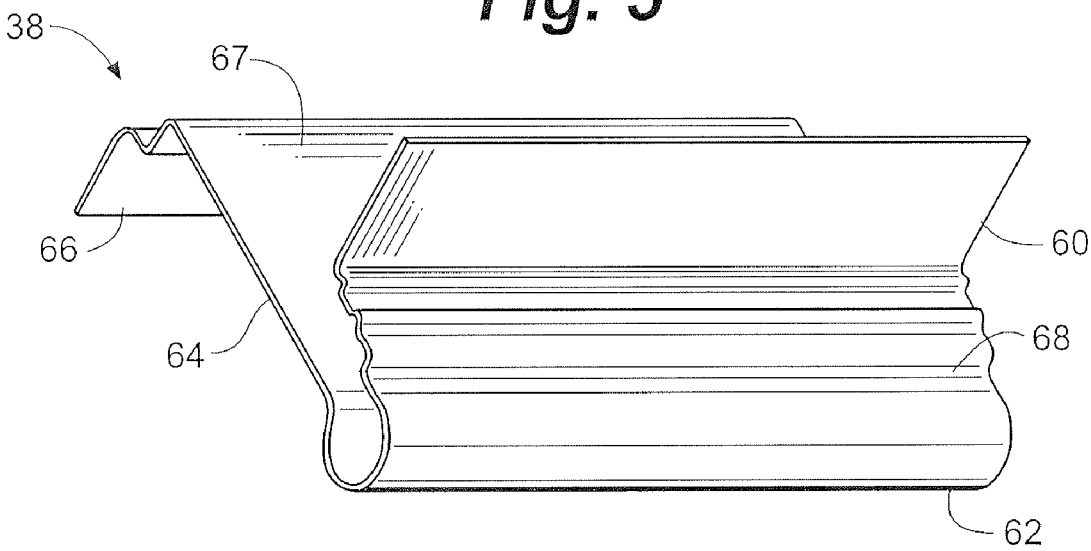
FIG. 5 is a partial perspective view of the z-bar of FIG. 4 in isolation.
Figure 6:
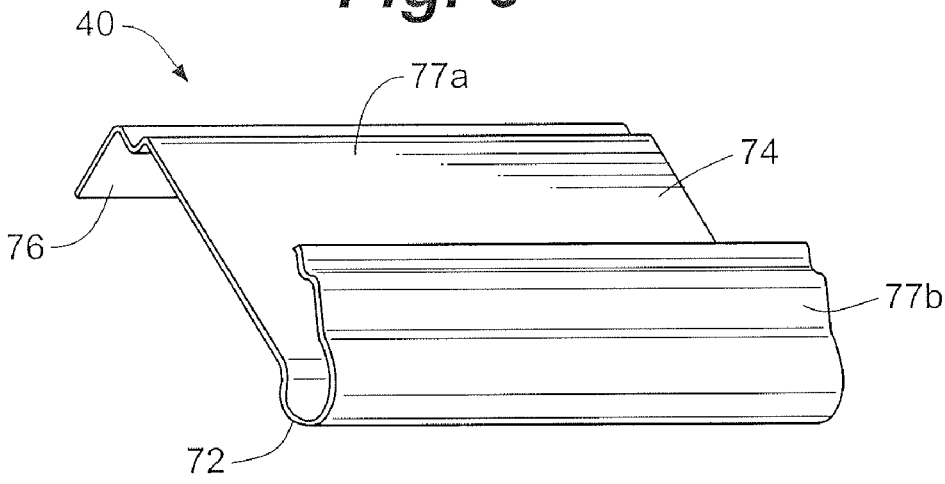
FIG. 6 is a perspective view of the z-bar extension member of FIG. 4 in isolation.
Figure 7:
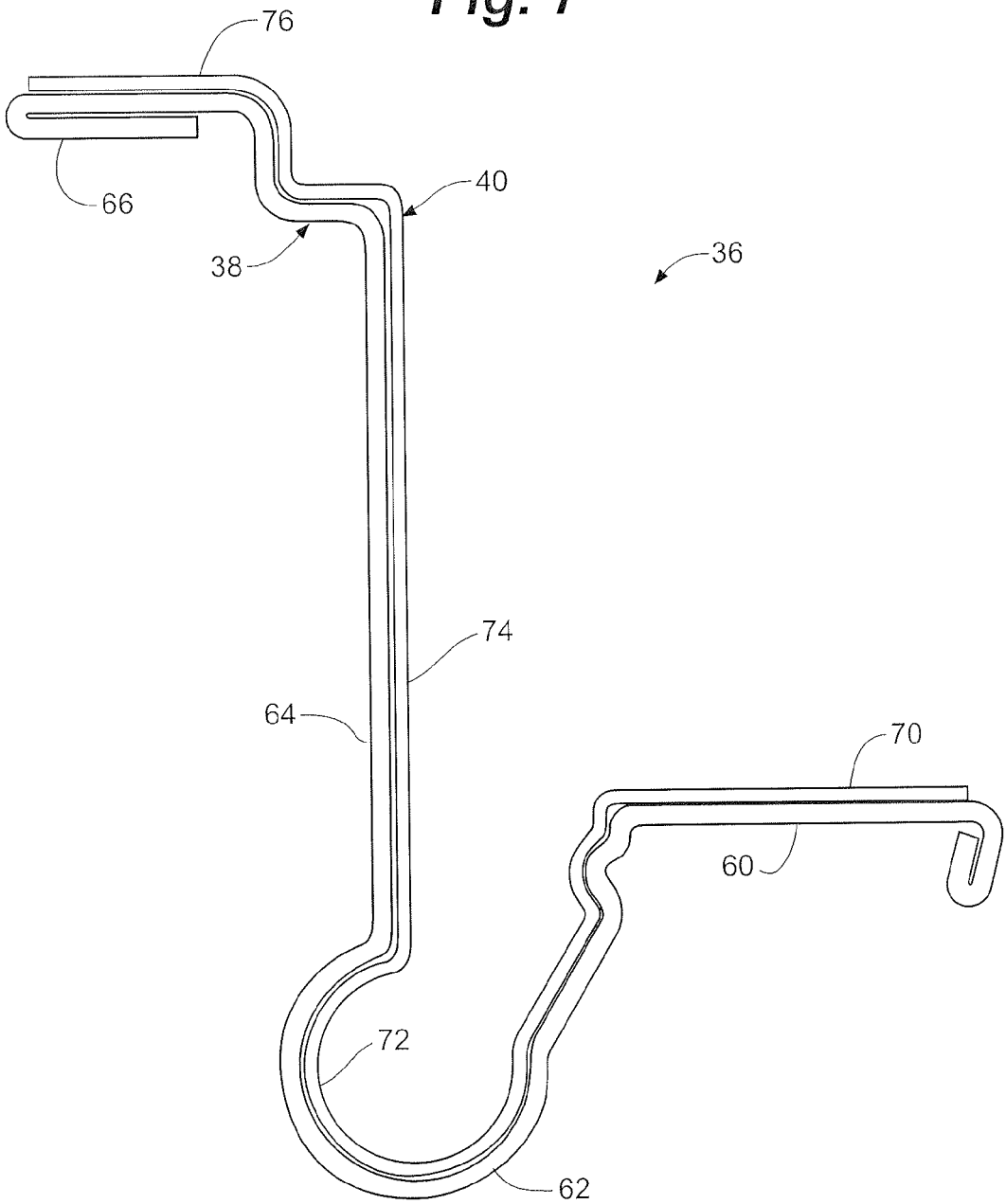
FIG. 7 is a cross-sectional view of an extended z-bar assembly according to an embodiment of the invention.

Referring to FIGS. 1 through 3, a door assembly 30 including an exterior door 32, a door frame or casing 34 and an extended z-bar assembly 36 having a z-bar 38 and a z-bar extension member 40 is depicted in one embodiment of the invention. The exterior door 32, which may be a storm door or a screen door, may include a door expander 44 and a hinge member 46. The door frame or casing 34 may include an exterior trim or door jamb 52, a sill 54 and a header (not depicted). The sill 54 may have an inclined upper surface 56. The z-bar 38 may be dimensioned so that a gap 57 exists between an end of the z-bar 38 and the sill 54. The gap 57 is bridged by the z-bar extension member 40.

Referring to FIGS. 4 through 8, various embodiments of the extended z-bar assembly are depicted. In one embodiment, the z-bar 38 includes a flange portion 60, a barrel portion 62, a web portion 64 and a projecting portion 66. The z-bar 38 may also be characterized as having an inward-facing surface 67 (e.g. the surface that generally faces the door jamb 52) and an outward-facing surface 68 (i.e. the surface opposite the inward-facing surface 67 that generally faces away from the door jamb 54 to which the z-bar 38 is mounted).

Figure 8:
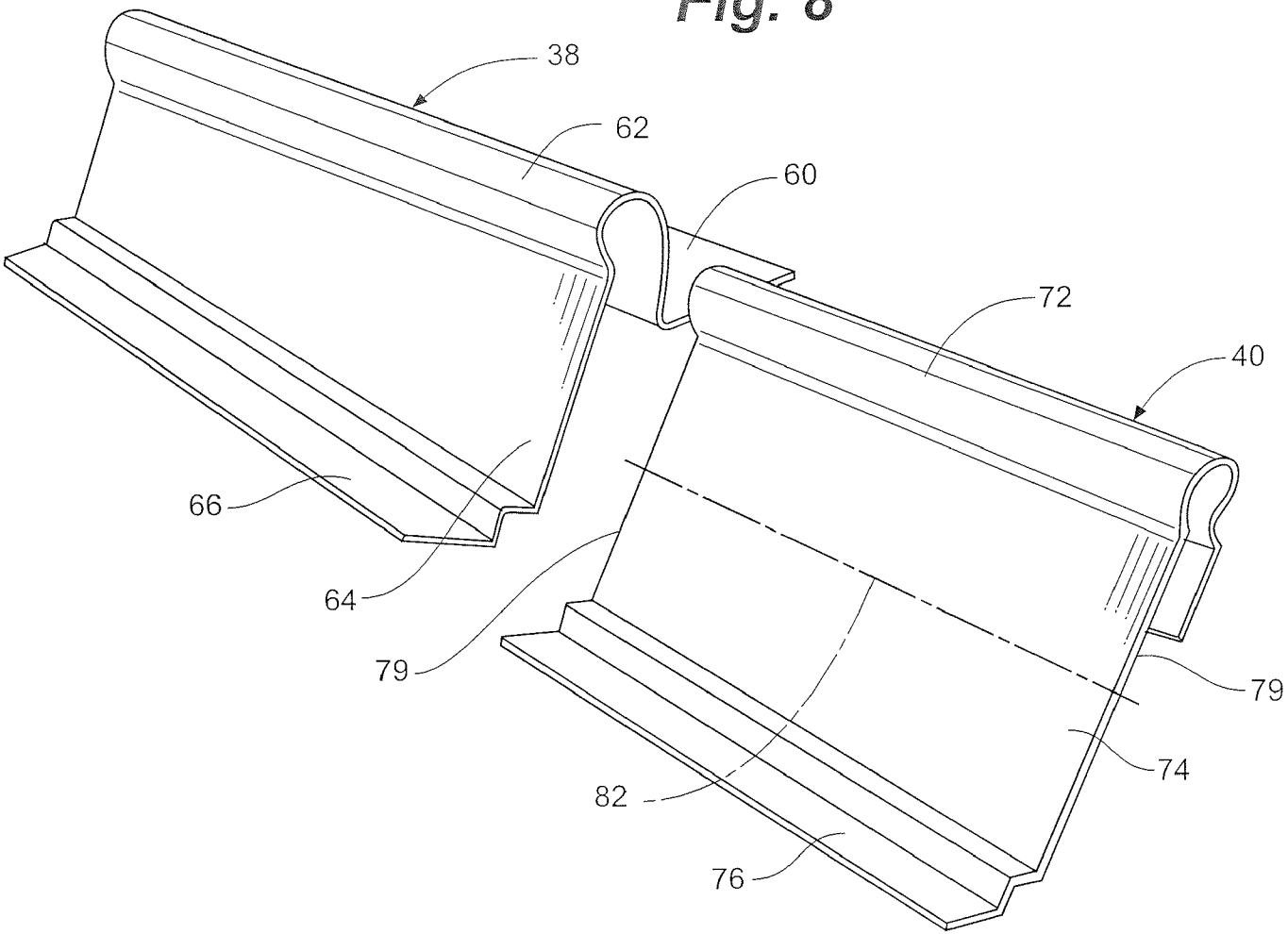
FIG. 8 is a perspective of the components of an extended z-bar assembly according to an embodiment of the invention.

An embodiment of the z-bar extension member 40 may include an extender flange portion 70, an extender barrel portion 72, an extender web portion 74 and an extender projecting portion 76. Not all of these portions are necessary in the construction of a z-bar extension member; some portions may be omitted and still provide effective extension of the z-bar assembly for functional or aesthetic purposes. Like the z-bar 38, the z-bar extension member 40 may also be characterized as having an inward-facing surface 77*a* and an outward-facing surface 77*b*. The z-bar extension member 40 may be slidably engaged with the z-bar 38. Note that some embodiments depicted in FIGS. 4 through 8 do not include the extender flange portion 70 (e.g. FIGS. 6 through 8). Also, the ends 79 of the z-bar extension member 40 may be substantially square with respect to a longitudinal axis 82 of the z-bar extension member 40 (FIG. 8).

Figure 9:
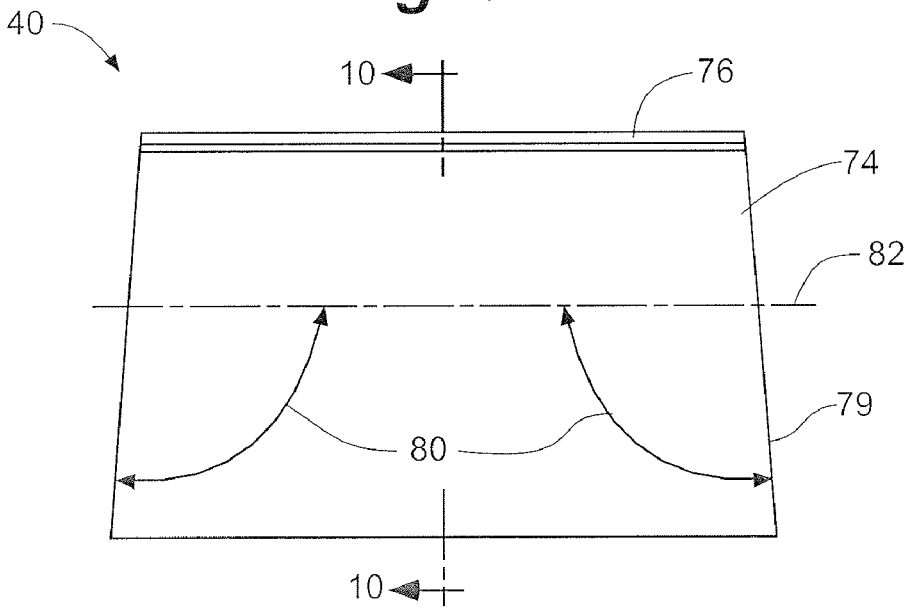
FIG. 9 is a side view of a z-bar extension member having ends with oblique angles in an embodiment of the invention.
Figure 10:
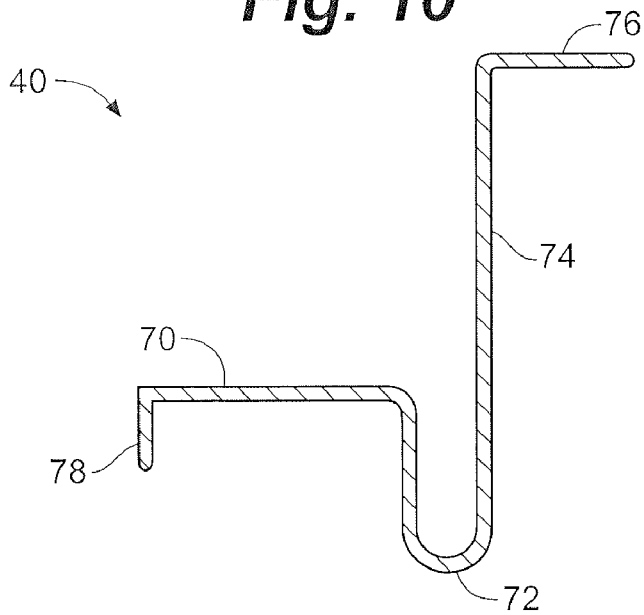
FIG. 10 is a cross-sectional view of the z-bar extension member of FIG. 9.
Figure 11:
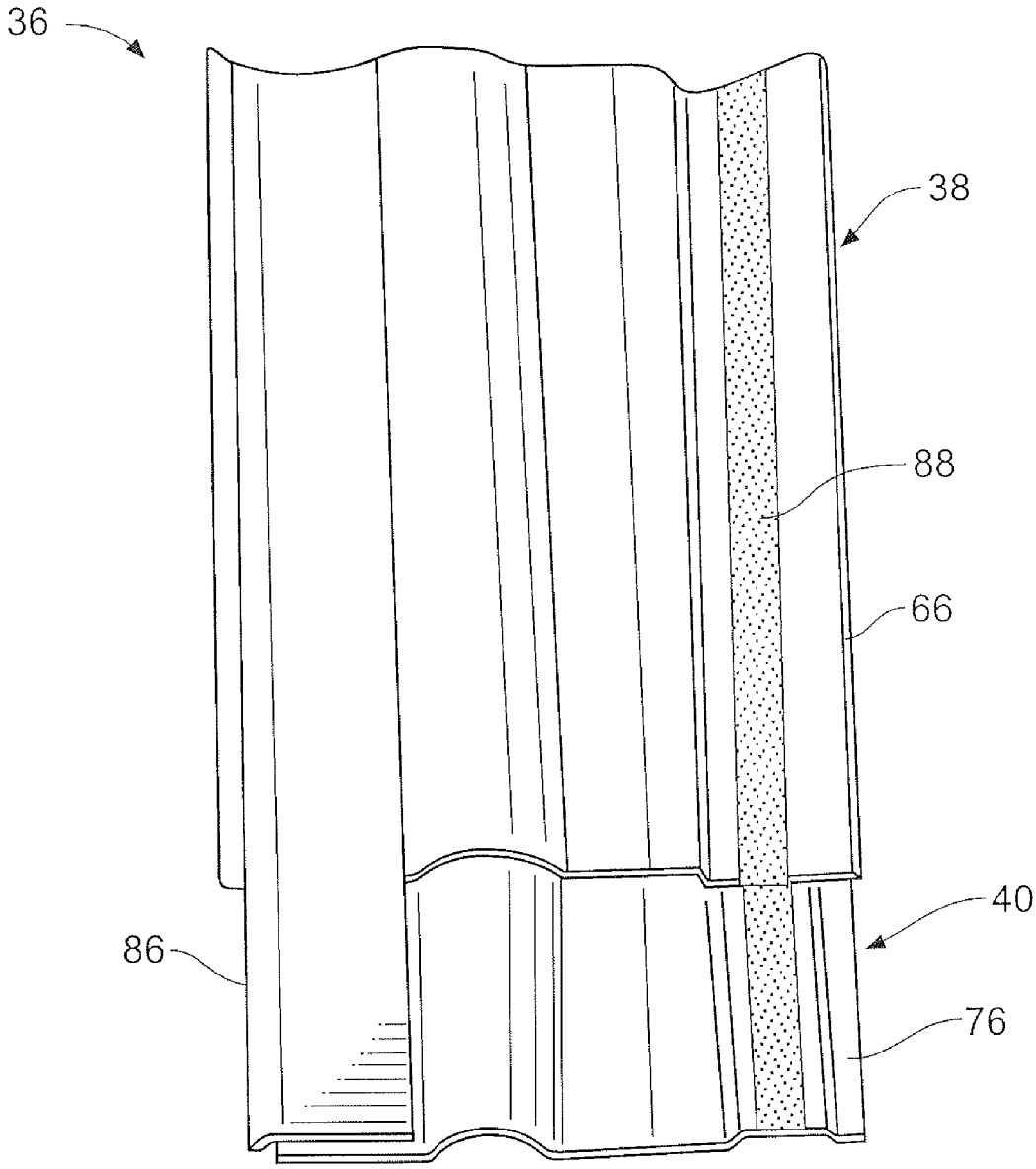
FIG. 11 is a perspective view of an extended z-bar assembly with weather stripping in an embodiment of the invention.
Figure 12:
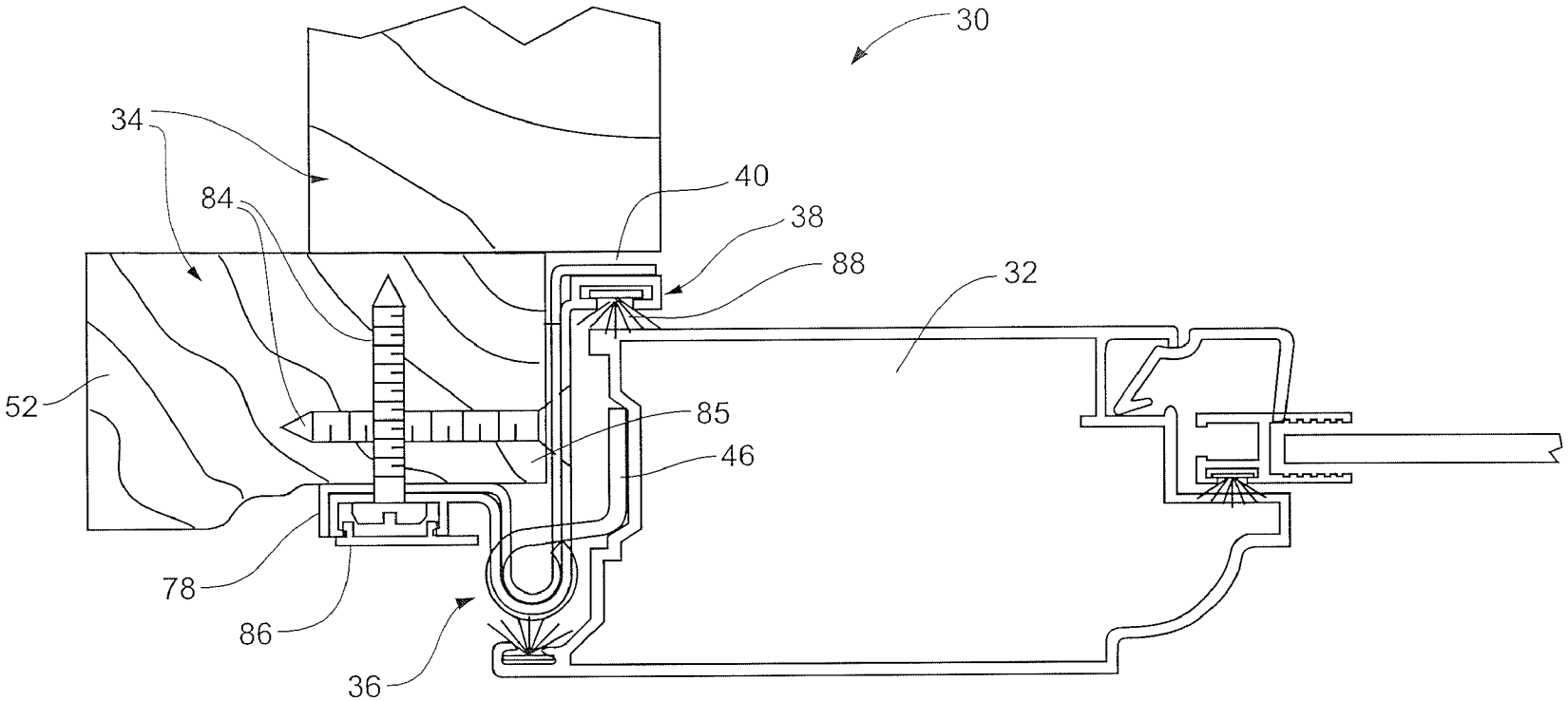
FIG. 12 is a cross-sectional view of an installed z-bar assembly in an embodiment of the invention.

Referring to FIGS. 9 and 10, an embodiment of the z-bar extension member 40 having ends 79 that define an oblique angle 80 relative to the axis 82 of the z-bar extension member 40 is depicted. The oblique angle 80 may be provided at just one end of the z-bar extension member, thereby defining a component that accommodates either the hinge side or the latch side of the door assembly 30 (but not both) without need for cutting an angle. The oblique angle 80 may also be provided on both ends, as depicted in FIG. 9, in which case the same z-bar extension member 40 may be used on the hinge side or the latch side of the door assembly 30. The z-bar extension member 40 may also include an extender flange projection 78 that projects outward from the extender flange portion 70.

The embodiment depicted in FIGS. 1 through 3 illustrate the z-bar extension member 40 as being located inside the z-bar 38. The extended z-bar assembly 36 may also be configured so that at least a portion of the z-bar extension member 40 is positioned over the z-bar 38. Also, if the z-bar extension member 40 is formed of a resilient material, the z-bar extension member 40 can be flexed and snapped into or over the z-bar 38, depending on the configuration.

Also, the embodiment depicted in FIGS. 1 through 3 illustrate the gap 57 as existing between the z-bar 38 and the sill 54. In another embodiment, a gap may exist between the z-bar 38 and the header (not depicted), and the z-bar extension member 40 installed to bridge therebetween.

Functionally, the z-bar extension member enables the z-bar 38 to be fabricated with a length that is intentionally shorter than the length of the door jamb 52. The barrel portion 62 of the z-bar 38 and the extender barrel portion 72 of the z-bar extension member 40 cooperate to guide the z-bar extension member 40 in an in-line or telescoping manner along the longitudinal axis 82 to bridge the gap between the z-bar 38 and the sill 54. The extender flange projection 78 projects normal to the mounting surface of the door jamb 52 along the outside edge of the flange portion 60 and provides an externally accessible means for gripping the z-bar extension member 40 for positioning during installation of the extended z-bar assembly 36.

The use of a resilient material for the z-bar extension member 40 that is mounted over the z-bar 38 (not depicted) enables installation of the z-bar extension member 40 after the z-bar 38 has been mounted to the door jamb 52. The z-bar extension member 40 may then be secured in place by means known in the art such as with additional fasteners or with an adhesive.

Referring to FIGS. 11 through 15, a variety of other embodiments of the invention are depicted in assembly. The extended z-bar assembly 36 is attached to the door jamb 52 of the casing 34 with fasteners 84 such as wood screws. The fasteners 84 may pass through the flange portion 60 and the web portion 64 of the extended z-bar assembly 36 to cover a corner 85 of the door jamb 52 that in part defines the exterior opening of the casing 34.

The flange portion 60 may also be formed with a pair of rails 87 that straddle the fasteners 84. A cap strip 86 may be formed to accommodate the rails 87 for placement over the heads of the fasteners 84.

Figure 13:
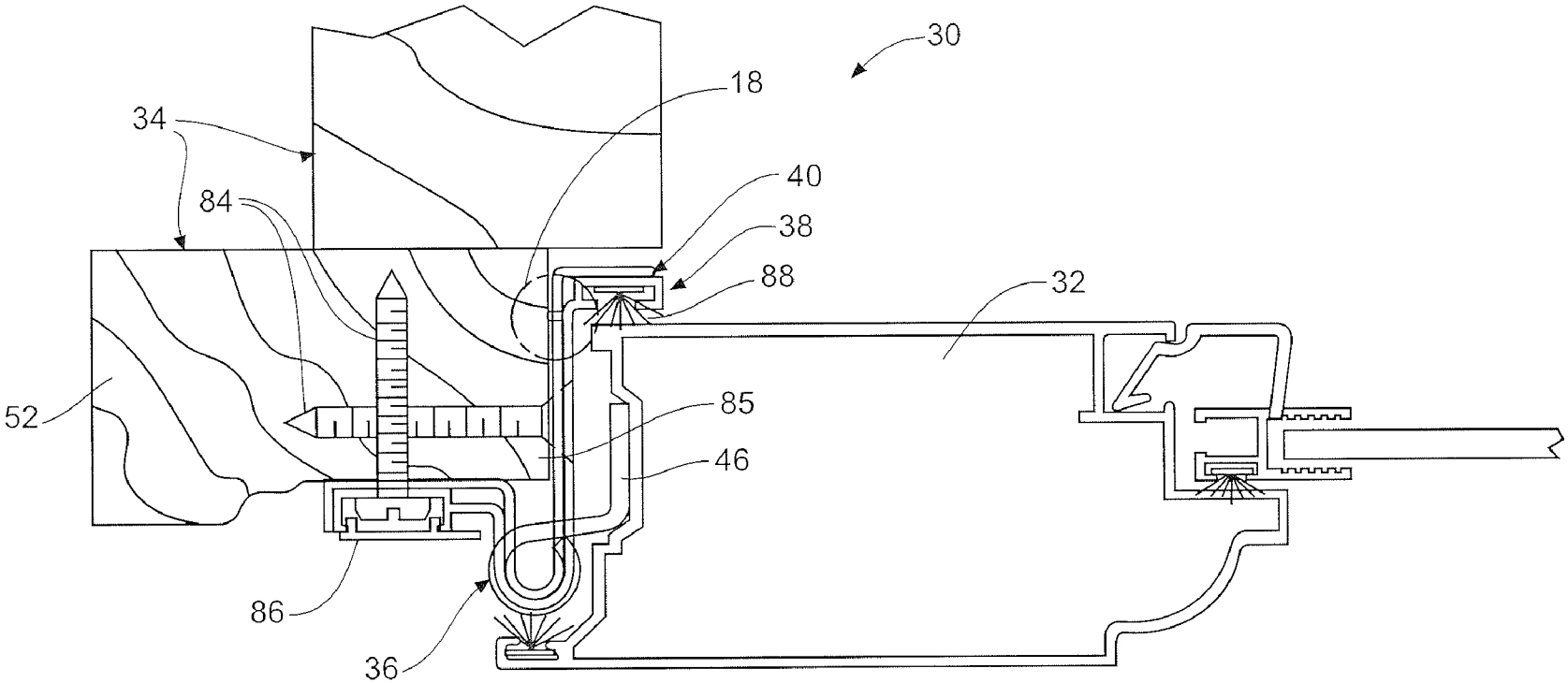
FIG. 13 is a cross-sectional view of an installed z-bar assembly having a spacer rib in an embodiment of the invention.
Figure 14:
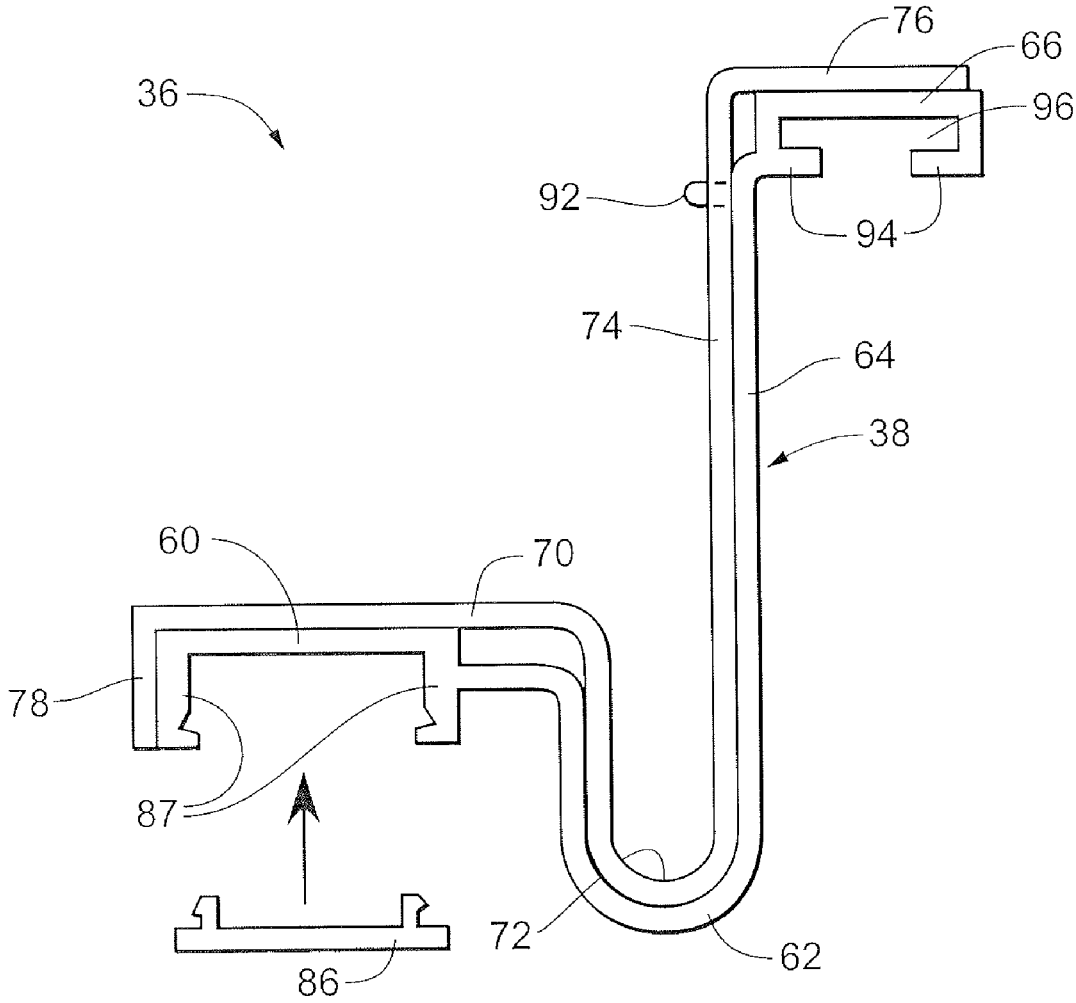
FIG. 14 is a partially exploded cross-sectional view of the extended z-bar assembly of FIG. 13 in isolation.

The embodiment of FIGS. 13 and 14 depict a rib 92 that projects from the web portion 64 of the z-bar 38 toward the door jamb 52. The rib 92 may or may not pass through the z-bar extension member 40 in final assembly.

A weather stripping 88 or other suitable material may be mounted to the face of the projecting portion 66. The projecting portion 66 may be formed with a pair of L-brackets 94 that define a track 96 for capturing the base of the weather stripping 88.

Figures 15, 15A, 15B:
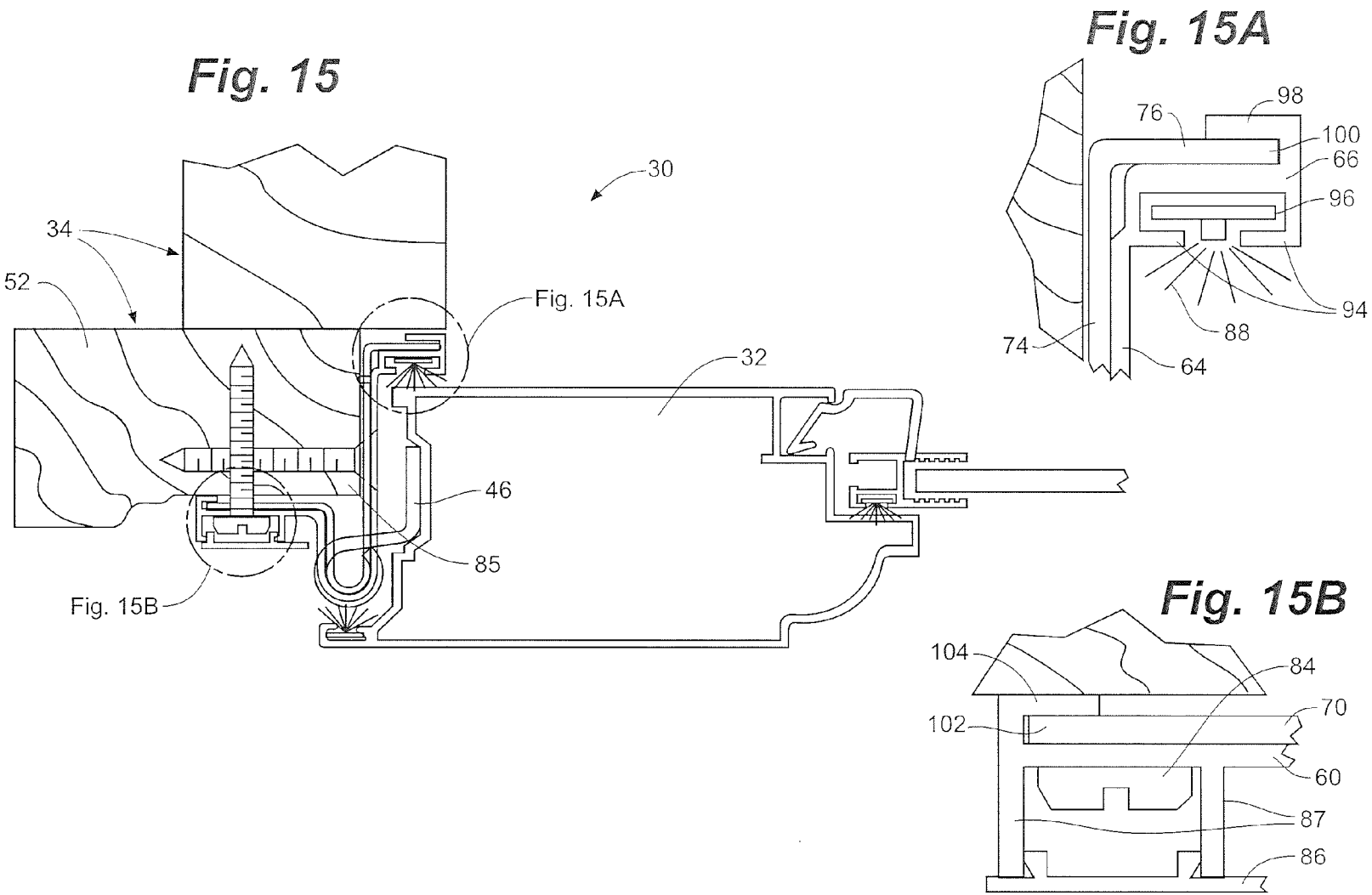
FIG. 15 is a cross-sectional view of an installed z-bar assembly having engaging slots for holding the extended z-bar assembly together in an embodiment of the invention.
FIGS. 15A and 15B are enlarged inset views of the cross-sectional view of FIG. 15.

Referring to FIGS. 15A and 15B, details of the configuration of FIG. 15 are depicted. In FIG. 15A, the projection portion 66 is limned as having a projection lip 98 that is substantially parallel with the projection portion 66 to define a slot 100. The end of the extender projecting portion 76 is seated within the slot 100 and captured by the projection lip 98. Likewise, FIG. 15B portrays a flange lip 102 that is substantially parallel with the flange portion 60 and defines a slot 104 that captures the edge of the extender flange portion 70. The slots 100 and 104 may be dimensioned to provide a frictional resistance between the z-bar 38 and the z-bar extension member 40.

Figure 16:
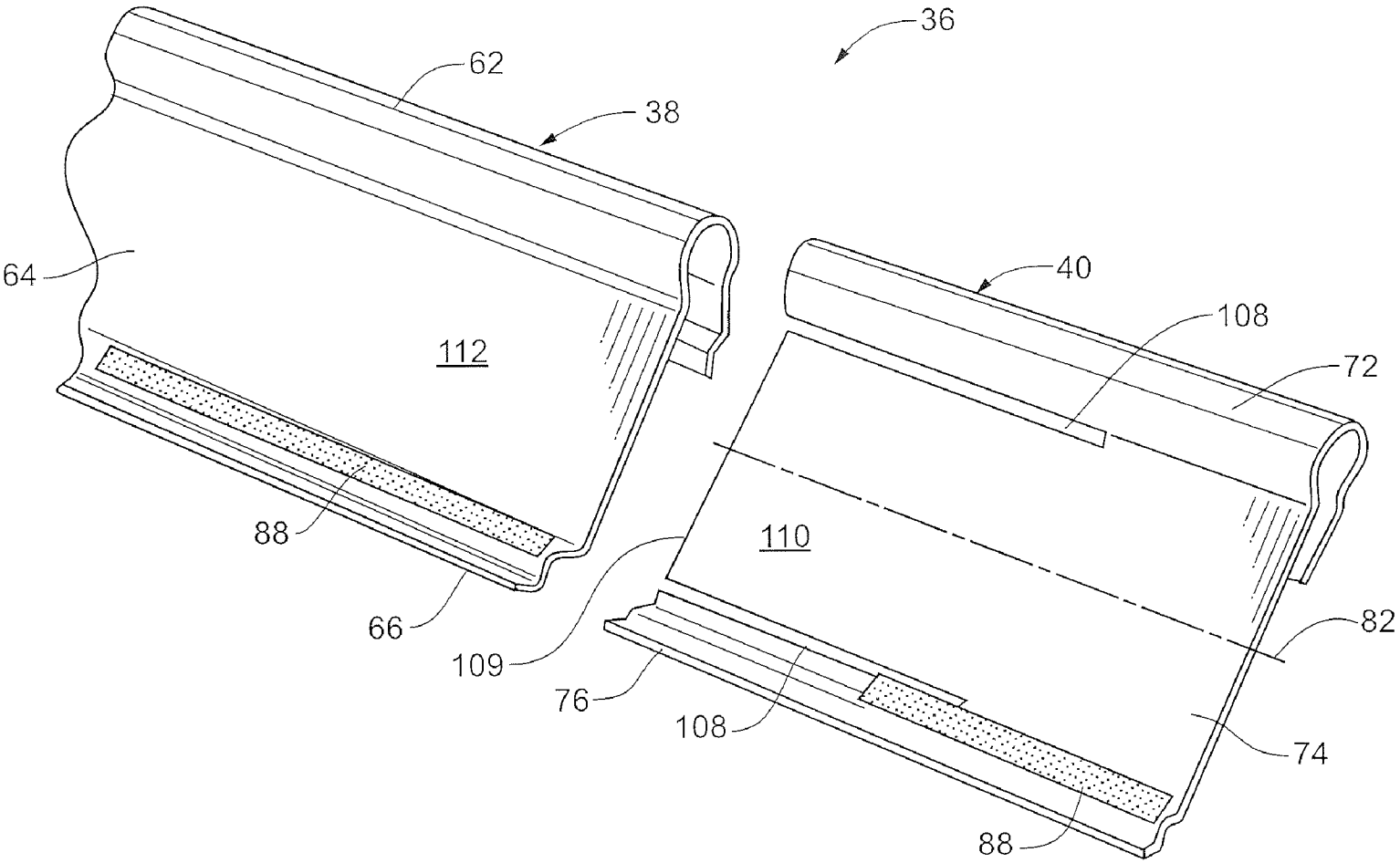
FIGS. 16 and 17 are perspective views of a tongue overlay configuration in an embodiment of the invention.
Figure 17:
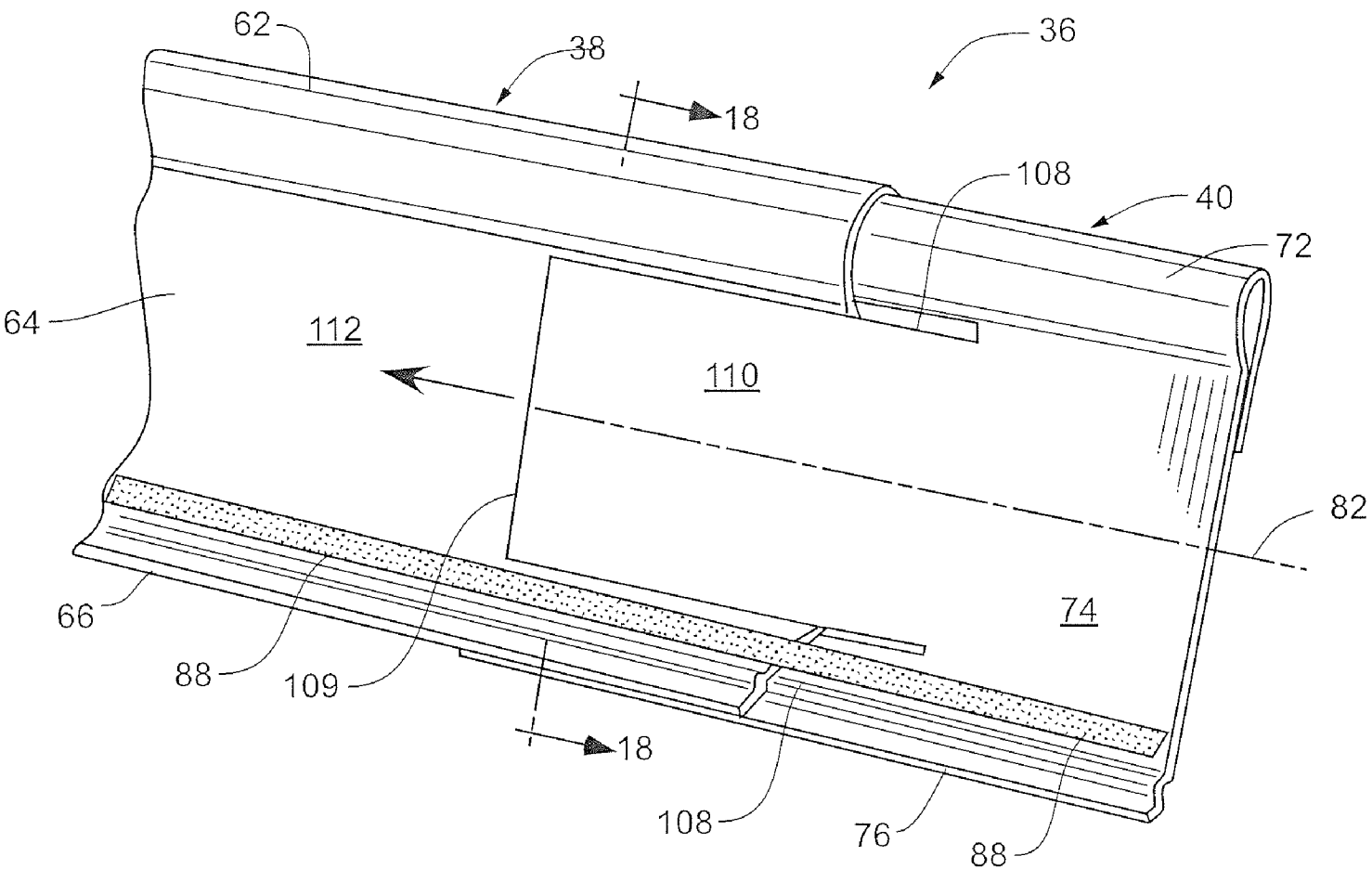
Figure 18:
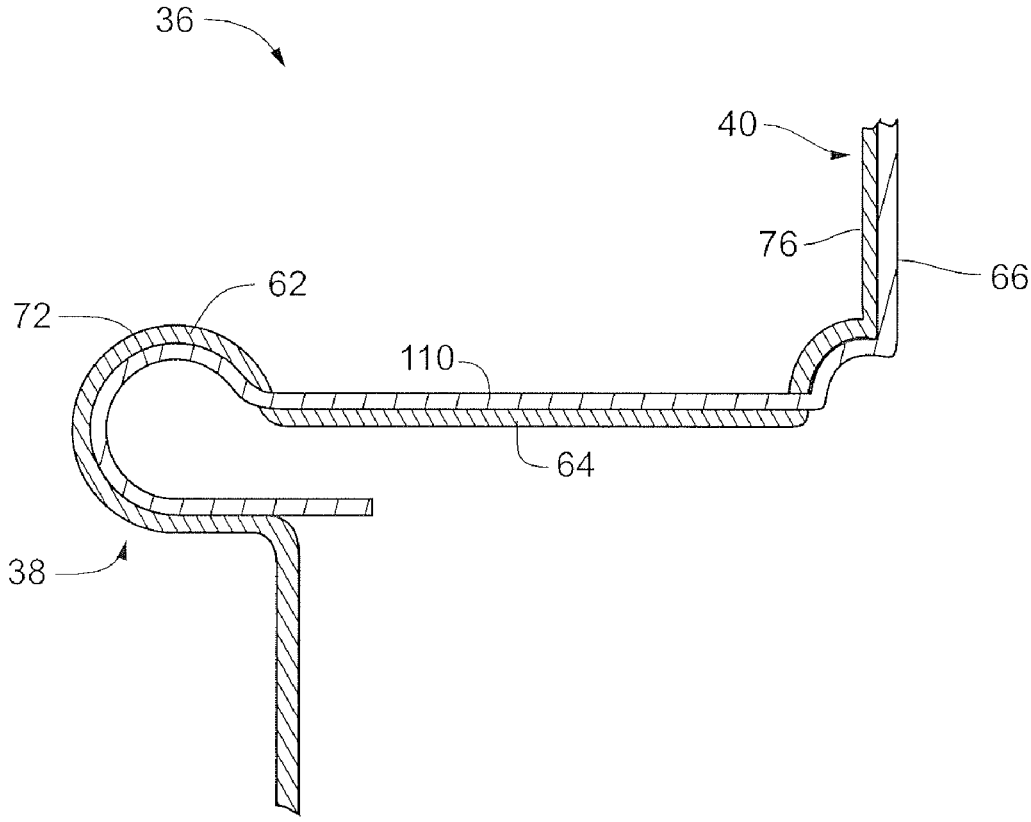
FIG. 18 is a cross-section of FIG. 17.

Referring to FIGS. 16 through 18, another embodiment of the extended z-bar assembly 36 is illustrated, including a pair of elongate slots 108 formed on the z-bar extension member 40. In the depicted embodiment, one elongate slot 108 is located near the junction of the extender barrel portion 72 and the extender web portion 74, the other near the junction of the extender projecting portion 76 and the extender web portion 74. The elongate slots 108 may extend from a proximal end 109 of the z-bar extension member 40 along a portion of the length of the z-bar extension member 40 to form a tongue portion 110 of the extender web portion 74. The elongate slots 108 may be substantially parallel to the longitudinal axis 82.

The weather stripping 88 can be attached to both the projecting portion 66 and the extender projecting portion 76. The weather stripping may be adhesively attached, or captured by a track or channel such as the track 96, or by other means known in the art. The weather stripping 88 may be pre-installed, running the full length of the z-bar extension member 40, and trimmed off when the desired length of the extended z-bar assembly 36 is established. Alternatively, the z-bar extension member 40 may be assembled without the weather stripping 88, and a strip of it provided for trimming and mounting to the z-bar extension member 40 after the extended z-bar assembly 36 has been mounted to the door jamb 52.

In assembly, the extender barrel portion 72 of the z-bar extension member 40 may be inserted into the barrel portion 62 of the z-bar 38. The z-bar extension member 40 may be formed so that the extender web portion 74, and therefore the tongue portion 110, overlays an outer face 112 of the web portion 64 of the z-bar 38. In this configuration, while the extender barrel portion 72 is engaged with the inward-facing surface 77*a* of the barrel portion 62 of the z-bar 38, the tab portion 110 is engaged with the outward-facing surface 77*b* of the web portion 64 of the z-bar 38 in an interlacing fashion (FIG. 18). The elongate slots 108 may be dimensioned to provide a frictional fit between the z-bar 38 and the z-bar extension member 40.

The number of elongate slots 108 is arbitrary, as well as their placement. Consider, for example, a single elongate slot extending parallel to the longitudinal axis 82. Such a configuration would enable the extension member 40 to engage both the inward-facing surface 77*a* and the outward-facing surface 77*b* of the z-bar. Likewise, more than two elongate slots can also be utilized for interlacing contact between the z-bar extension member 40 and the z-bar 38.

Referring to FIGS. 19 through 22, various structures for maintaining the lineal relationship between the z-bar 38 and the z-bar extension member 40 are illustrated. The FIG. 19 embodiment includes a plurality of mating projections 138 that extend outward from the extender web portion 74. In the embodiment depicted, the mating projections 138 are in pairs at a given longitudinal location along the longitudinal axis 82. The mating projections 138 of each pair are separated at a lateral spacing 139. A plurality of mating apertures 140 are formed on the web portion 64 of the z-bar 38, also in pairs having a lateral spacing 139 at a given longitudinal location. The mating projections 138 are dimensioned to engage with the apertures 140. The layout (dimensional spacing) of the mating projections 168 and the mating apertures 140 are the same, and the respective pairs can be spaced at equal intervals 145.

Figure 20:
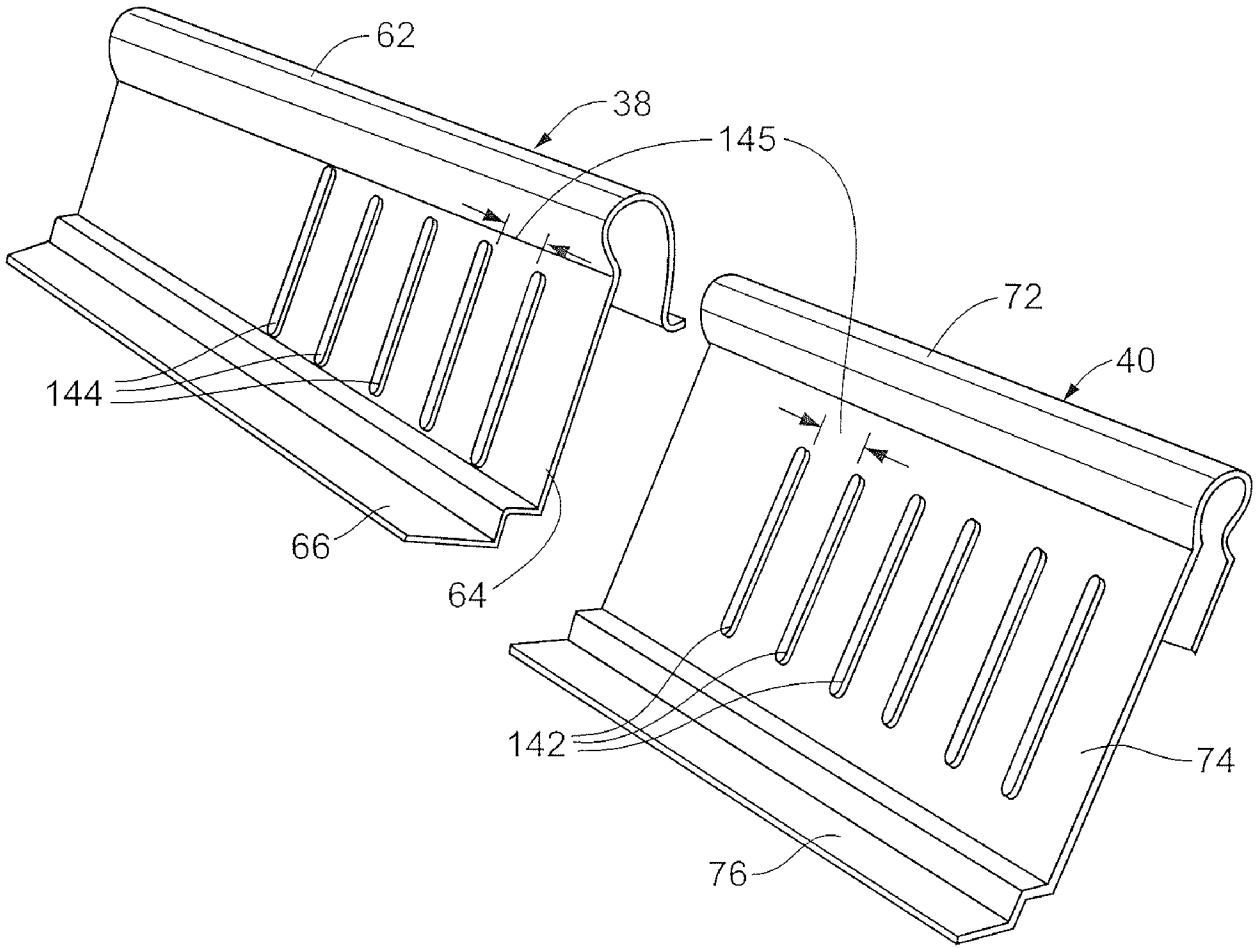
FIG. 20 is a perspective view of a projection and aperture mating system having elongate structures in an embodiment of the invention.

A similar concept is illustrated in FIG. 20. Instead of paired projections and apertures, the web portions 64 and 74 can include elongate mating projections 142 and elongate mating apertures 144 spaced at uniform intervals 145.

Figure 19:
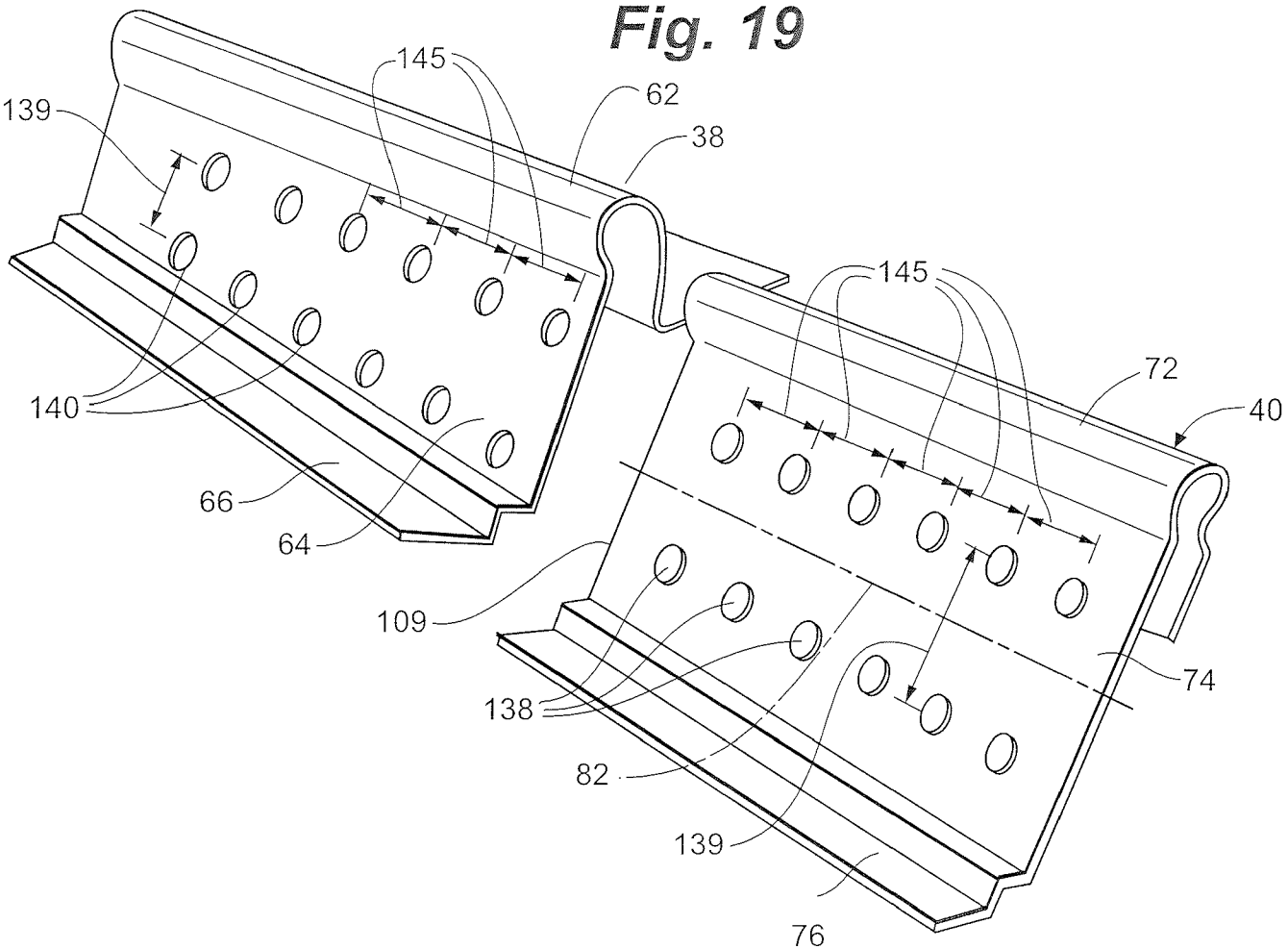
FIG. 19 is a perspective view of a projection and aperture mating system having paired structures in an embodiment of the invention.
Figure 21:
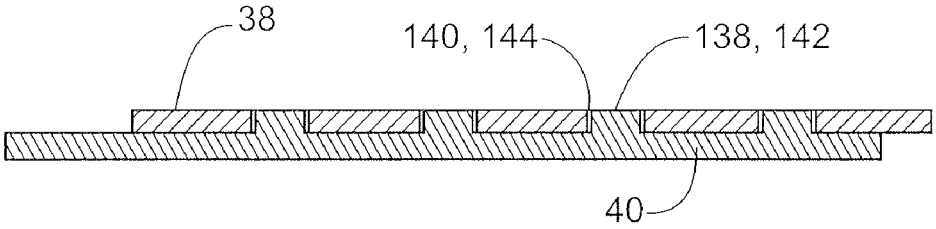
FIG. 21 is a cross section representative of both the FIG. 19 and the FIG. 20 embodiments.

The cross-sectional depiction of FIG. 21 depicts how the embodiments of FIGS. 19 and 20 can appear after assembly.

Figure 22:
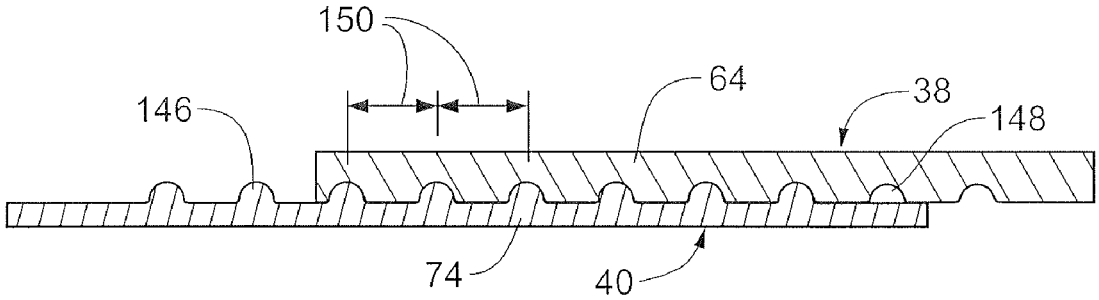
FIG. 22 is a cross-section of a detent and groove mating system in an embodiment of the invention.

An embodiment of similar concept is portrayed in FIG. 22. In this embodiment, the extender web portion 74 is formed with a plurality of detents 146, and the web portion 64 is formed with a plurality of grooves 148. The detents 146 and grooves 148 can have a uniform spacing 150 and can be formed to mate or interlock with each other.

It is noted that the various projections, apertures, detents and notches are not limited to being formed on the components specified in FIGS. 19 through 22. For example, in the FIG. 19 embodiment, mating projections may be formed on the interior of the web portion 64 to cooperate with mating apertures formed on the extender web portion 74. Also, the detents of FIG. 22 may be utilized in the embodiments of FIGS. 19 and 20. Furthermore, the positive locking concepts illustrated in FIGS. 19 through 22 may be incorporated with the sliding tab configuration of FIGS. 13 through 16.

In operation, the z-bar extension member 40 may be slid inside the z-bar 38 until the extended z-bar assembly 36 is at or near a desired length. Depending on the embodiment utilized, at least a portion of the mating projections 138, 142 or the detents 146 are then aligned with the nearest corresponding mating apertures 140, 144 or the grooves 148 and snapped into place. The resolution of the adjustment can be minor fractions of an inch, depending on the spacing of the intervals 145, 150 and the dimension of the mating apertures 140, 144 or grooves 148.

For the embodiment that includes the rib 92, the rib 92 serves as a spacer to accommodate the thickness of the z-bar extension member 40, thereby augmenting adjustment of the z-bar extension member 40 after the extended z-bar assembly 36 has been mounted to the door jamb 52.

The slots 100 and 104 can serve to secure the z-bar extension member 40 in slidable engagement with the z-bar 38 during installation. The slots 100 and 104, if properly dimensioned, also provide a frictional resistance between the z-bar 38 and z-bar extension member 40 that temporarily holds the z-bar extension member 40 in a fixed relationship in line with the z-bar 38 during the installation process.

The various components of the extended z-bar assembly 36 may be made of any suitable material such as extruded metal, forged metal, ferrous or non-ferrous metals, or a resilient material such as high density plastic. Extrudable materials include, but are not limited to, aluminum, aluminum alloy and composite resin materials. The z-bar assembly or components thereof may be of a roll formable material, such as aluminum, aluminum alloy or steel.

Figure 23:
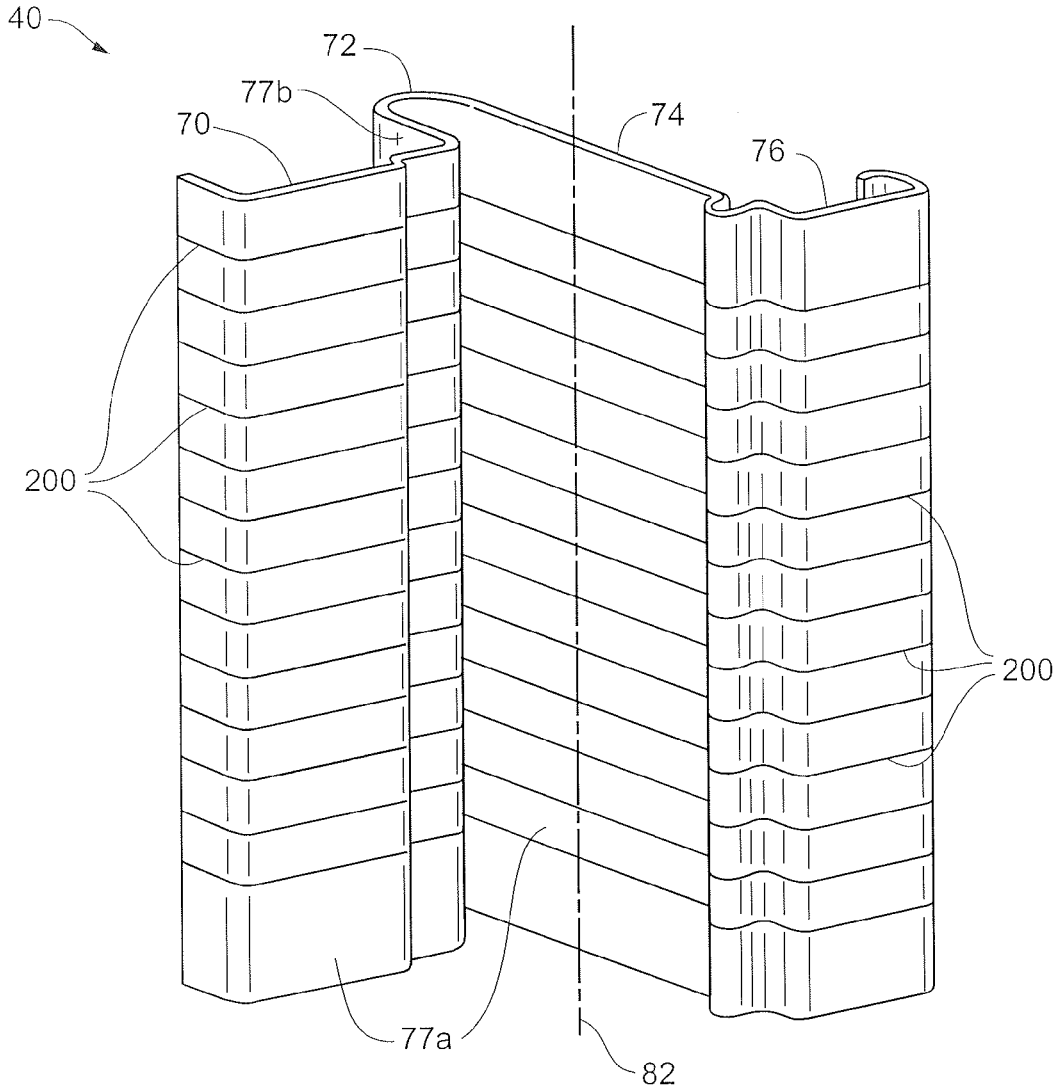
FIG. 23 is a perspective view of a z-bar extension member with score lines in an embodiment of the invention.

Referring to FIG. 23, another embodiment of the z-bar extension member 40 is depicted wherein the z-bar extension member 40 further includes a plurality of score lines 200. The score lines 200 may extend laterally across the z-bar extension member 40 (i.e. across the width of the z-bar extension member 40). In some embodiments, score lines 200 extend across one or more of the flange portion 70, the barrel portion 72, the web portion 74, and the projecting portion 76 of z-bar extension member 40. The score lines 200 can be formed on one side of z-bar extension member 40 (e.g. on the inward-facing surface 77*a*, as depicted), or alternatively on both sides of z-bar extension member 40.

The score lines 200 on the z-bar extension member 40 may comprise grooves that extend into the thickness of the z-bar extension member 40. In this configuration, the z-bar extension member 40 may be rendered frangible or additionally scored at one of the score lines 200 for frangible separation. Alternatively, the score lines 200 may comprise printed guidelines to guide the installer in scoring the z-bar extension member 40.

In operation, the frangible score lines 200 may enable the length of the z-bar extension member 40 to be modified by snapping off z-bar extension member 40 at the desired score line 200. In one embodiment, the z-bar extension member 40 may be snapped off by application of a manual force. In another embodiment, additional tools such as clamps or wrenches may be used to assist an installer to snap z-bar extension member to a desired length.

For z-bar extension members 40 having the score lines 200 located only on the inward-facing surface 77*a*, the outward-facing surface 77*b* may have a smooth finish, which may have desirable aesthetic and maintenance qualities.

Where guide lines or light score lines are utilized instead of frangible score lines, the installer may cut the z-bar extension member 40 to any length whether on the guideline or not. The guidelines may provide the installer with sufficient resolution to create a desired cut between the guidelines.

In another embodiment of the invention, the score line concept is applied to the z-bar 38 (not depicted). That is, a plurality of score lines may be located proximate one or both ends of the z-bar 38 to enable an installer to readily shorten the z-bar. In this way, the z-bar 38 may be oversized initially. The scored lines on the z-bar 38 can be configured in any of the variety of ways discussed in relation to the scored lines 200 on the z-bar extension member 40.

During installation, the installer could shorten the scored z-bar 38 for suitable clearance between the z-bar 38 and the sill 54 and/or header. Such clearance, however, may be less than a z-bar manufactured to provide clearance over a variety of door sizes, thus enabling coverage of the clearance gap with a shorter z-bar extension member 40 (or, in some cases, without need for a z-bar extension member at all). Generally shorter z-bar extension members may provide functional advantages to the door assembly, such as an ability to seal the entire inward-facing surface 77*a* with a caulk or sealant to provide a more reliable moisture and/or thermal barrier. The shorter z-bar extension member may also provide aesthetic advantages as well.

In various embodiments, the length of z-bar extension member 40 may be modified by additionally scoring and/or cutting the z-bar extension member 40 using the desired score line 200 as a guide. Tools may be used to perform this operation, such as a saw, utility knife, hot wire, or other cutting tool. Also, the score lines 200 may be formed at an obtuse angle relative to the longitudinal axis 82 to conform to a given sill incline angle after being trimmed (not depicted).

Referring to FIGS. 24 and 24A through 24D, a z-bar assembly 230 including the z-bar 38 and a molded z-bar extension member 240 comprising a moldable material is depicted in an embodiment of the invention. As in the previous embodiments, the molded z-bar extension member 240 may include an extender flange portion 270, an extender barrel portion 272, an extender web portion 274 and an extender projecting portion 276. The z-bar extension member 240 may also be characterized as having an inward-facing surface 278 and an outward-facing surface 280.

Figure 24:
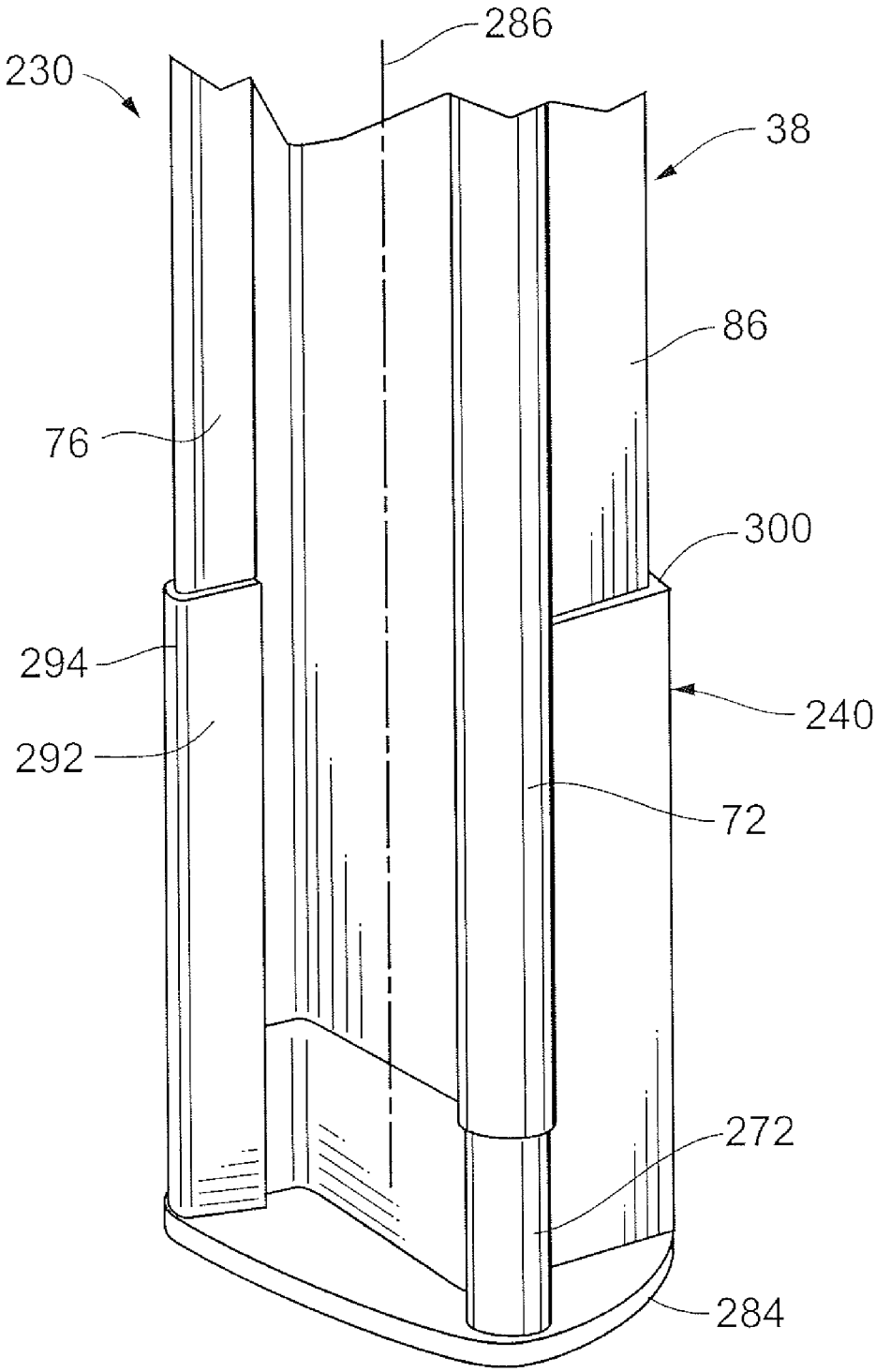
FIG. 24 is a perspective view of a z-bar assembly in an embodiment of the invention.
Figure 24A:
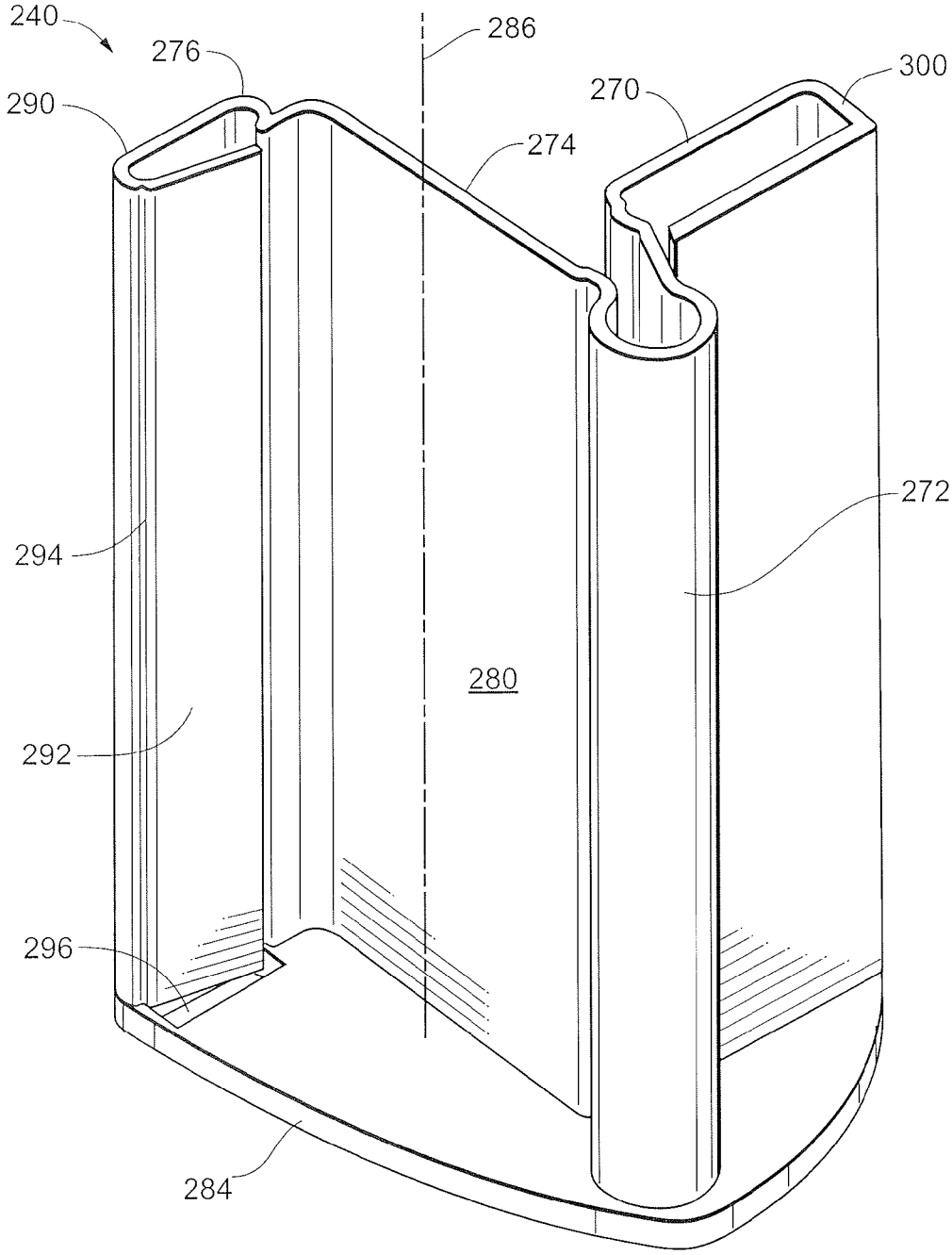
FIGS. 24A and 24B are perspective views of the z-bar extension member of FIG. 24 in isolation.
Figure 24B:
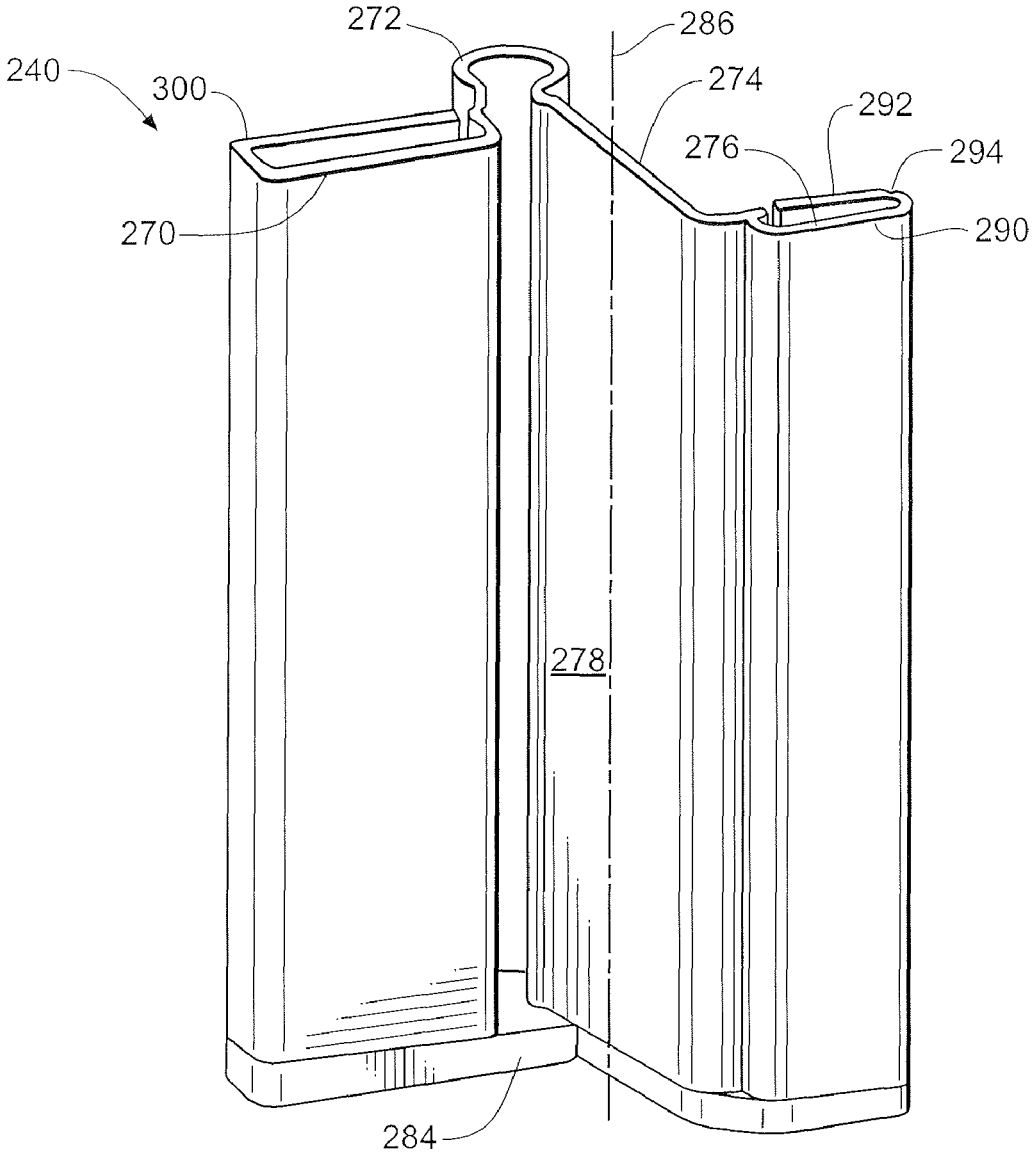
Figure 24C:
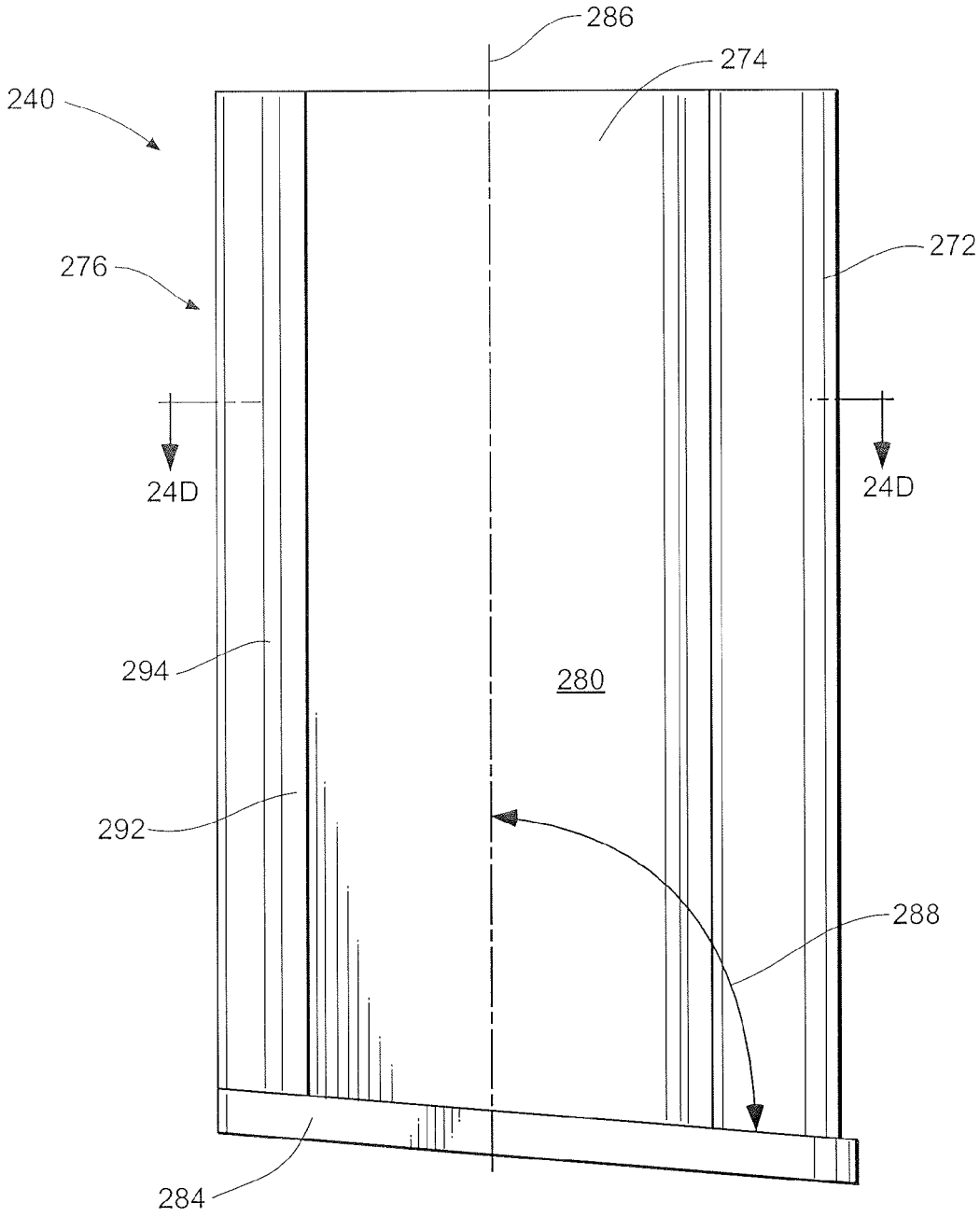
FIG. 24C is an elevation view of the z-bar extension member of FIG. 24 in isolation.
Figure 24D:
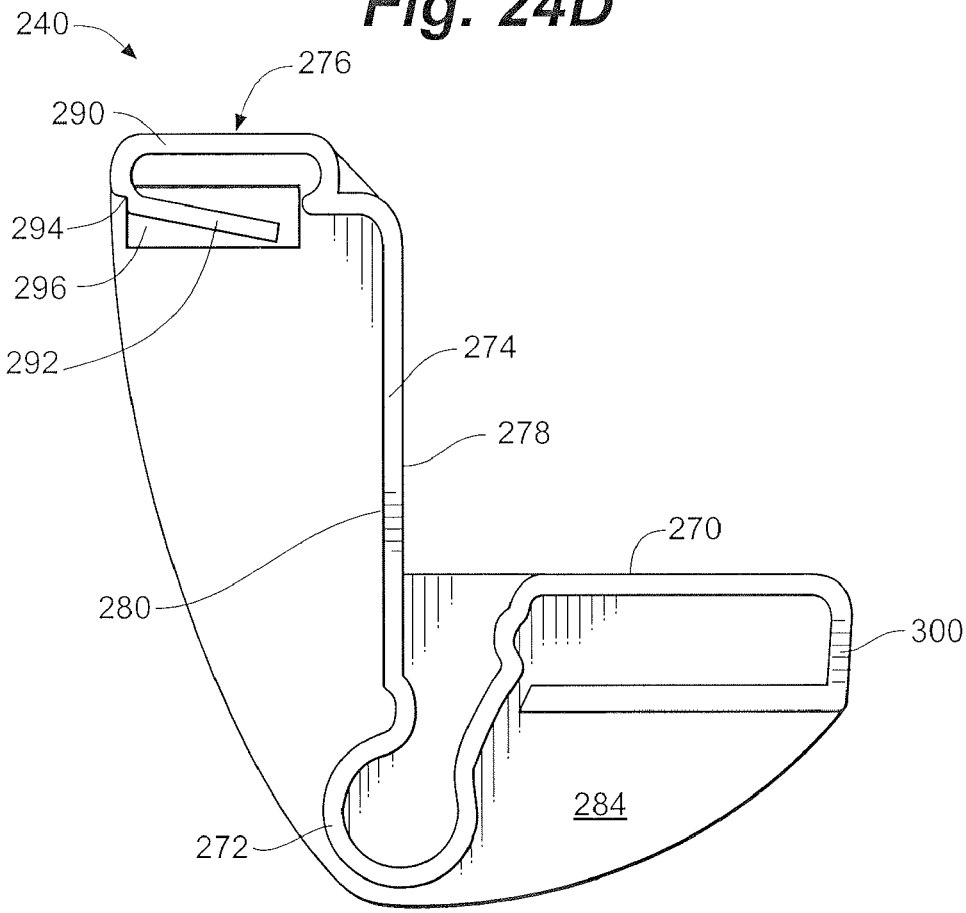
FIG. 24D is a section view of the z-bar extension member of FIG. 24C.

In one embodiment, a base portion 284 may be attached or integrally formed on one end of the molded z-bar extension member 240. For the molded extender 240, an integrally formed base 284 may be effected by the shape of the mold. The base portion 284 may be generally perpendicular with a longitudinal axis 286 of the z-bar assembly 230. Alternatively, the base 284 may define an obtuse angle 288 (i.e. an angle that is greater than 90 degrees), as depicted in FIG. 24D.

The extender projecting portion 276 may include a slot or channel portion 290 and a deflecting portion 292. The channel portion 290 and the deflecting portion 292 may be connected through a flexure or hinge portion 294 such as a living hinge. The base portion 284 may be formed with an aperture 296 immediately adjacent the deflecting portion 292. In this way, the deflecting portion 292 is not directly connected to the base portion 284, thus enabling the deflecting portion 292 to rotate about the hinge portion 294.

The extender flange portion 270 may include a pocket structure 300 sized to accommodate the flange portion 60, rails 87 and cap strip 86 of an embodiment such as depicted in FIG. 14. In cross section, the pocket structure 300 may form a closed loop (not depicted) or a partially closed loop (as depicted).

The molded z-bar extension member 240 is generally comprised of a moldable material. Moldable materials include, but are not limited to, polypropylene, polyvinyl chloride (PVC), nylon, polycarbonate, acrylonitrile butadiene styrene (ABS), styrene and delrin. Other moldable materials available to the artisan may be utilized.

Functionally, the molded z-bar extension member 240 may be slidably engaged with the z-bar 38. The channel portion 290 cooperates with the projecting portion 76 of the z-bar 38 to help secure the molded z-bar extension member 240 to the z-bar 38. When the door is brought into contact with the deflecting portion 292, the deflecting portion 292 can act as a positive sealing member against the door, thereby serving as a barrier or seal akin to a weatherstrip. Alternatively, the deflecting portion 292 may be excluded from the z-bar extension member 240 and weather stripping mounted to the z-bar 38 left exposed to perform the barrier function. Weatherstrip may also be adhesively attached to the projecting portion 276 to extend weather barrier protection beyond the end of the z-bar 38.

The pocket structure 300 may be dimensioned to surround the lower end of the cap strip assembly (as depicted) or to abut with the cap strip 86. The partial loop depicted in FIG. 24 enables any water that enters the pocket from the top to drain out. Alternatively or additionally, slits or holes (not depicted) may be formed at the base of the pocket structure 300 for the drainage function.

The obtuse angle 288 between the base potion 284 and the longitudinal axis 286 may be formed to correspond with the incline of a sill (e.g. sill 54 of FIG. 1). The base portion 284 may serve as sealing structure that engages a door expander spline at the base of a door expander (not depicted) for a better seal between the door expander spline and the sill.

In other embodiments, the base may be formed separately. In these embodiments, the z-bar extension member and/or separate base may be formed by a process such as molding, extrusion, or roll forming, then glued, fused, fastened or otherwise connected to the molded z-bar extension member.

Figure 25:
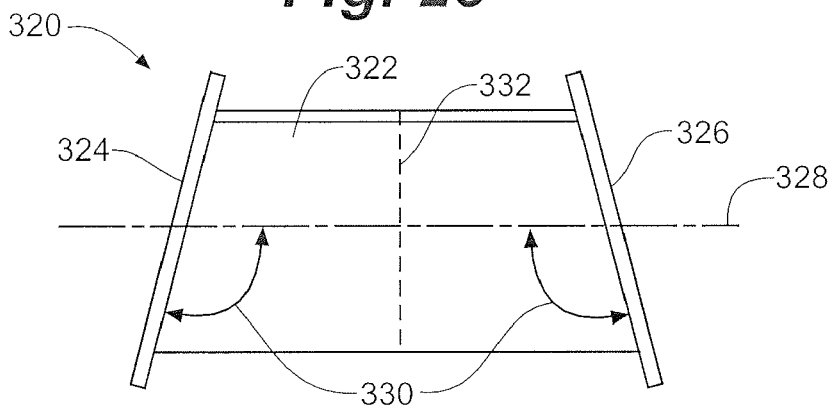
FIG. 25 is a side view of a dual base z-bar extension member having a base on each end with and with oblique angles in an embodiment of the invention.

Referring to FIG. 25, a dual base z-bar extension member 320 having an extension portion 322, a first base portion 324 and a second base portion 326 is depicted in an embodiment of the invention. The extension portion 322 may define a longitudinal axis 328. The ends may form substantially right angles with respect to the longitudinal axis 328 (not depicted) or obtuse angles 330 with respect to the longitudinal axis 328 (as depicted).

Functionally, the dual base z-bar extension member may be severed along a line 332 between the first and second base portions 324 and 326 to provide left side and right side z-bar extension members. Severability may be provided by a score line, or the user may cut the dual base z-bar extension member 320 at an arbitrary location between the first and second base portions 324 and 326.

Figure 26A:
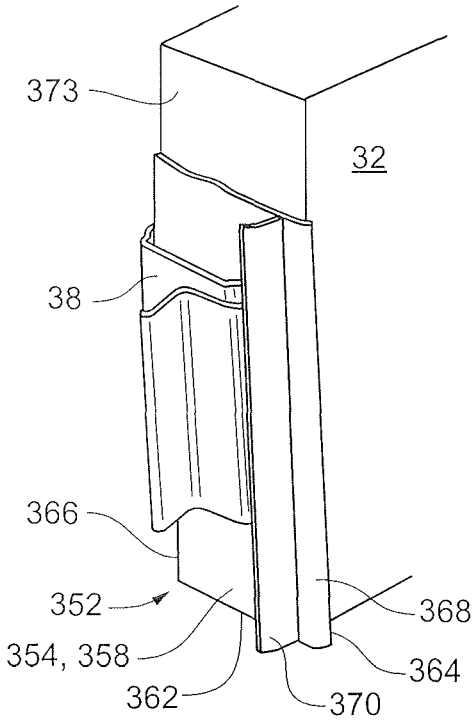
FIG. 26A is a partial cut away view of a guard assembly in an embodiment of the invention.
Figure 26B:
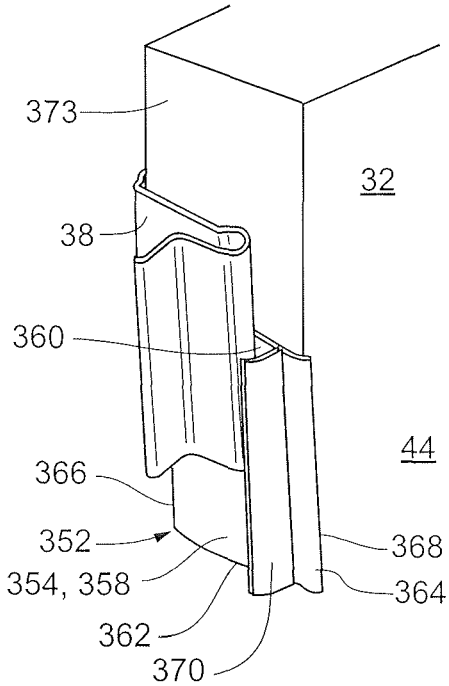
FIG. 26B is a partial perspective view of a guard assembly for capping an expander in an embodiment of the invention.
Figure 26C:
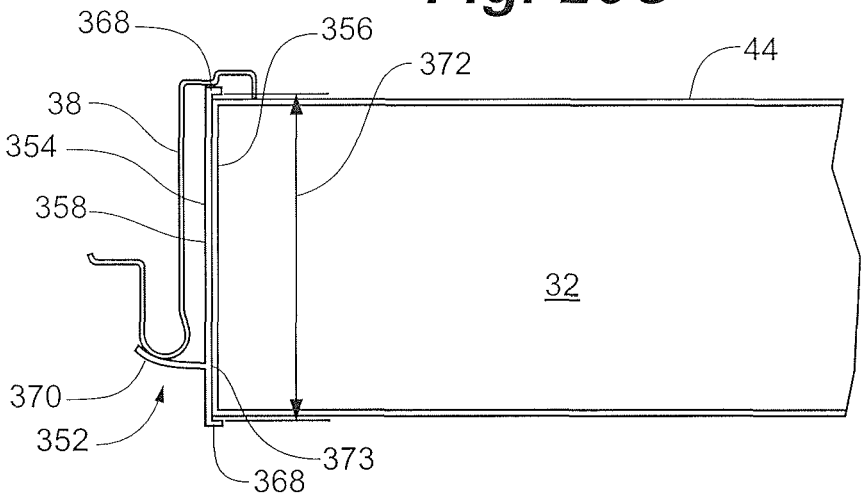
FIG. 26C is a top view of the guard assembly of FIG. 26B.

Referring to FIGS. 26A through 26C, a guard assembly 352 is depicted in another embodiment of the invention. The guard assembly 352 may be comprised of a base portion 354 having a first major surface 356, a second major surface 358, a top end 360, a bottom end 362, a front edge 364 and a back edge 366. One or more rail portions 368 may extend in a direction substantially orthogonal to the first major surface 356. A shield portion 370 may extend from the second major surface 358. The rail portions 368 and the shield portion 370 may be formed integral to the base portion 354, and may be flush with the front and back edges 364 and 366. A spacing 372 may be defined between rail portions 368 so that the guard assembly 352 effectively caps a vertical edge 373 of the door 32.

In one embodiment, the guard assembly 352 may be operatively coupled to the vertical edge 373 of the door 32. The length of the guard assembly may cover substantially the entire length of the vertical edge 373 of the door 32, or a portion thereof.

The guard assembly may serve as an end cap to the door expander 44. The spacing 372 between the rail portions 368 may be dimensioned to provide an interference or snap-on fit between the end of the door expander 44 and the guard assembly 352. The guard assembly 352 may be sized so that the top end 360 extends above the door expander 44 and the bottom end 362 extends below the door expander 44 so as to cover the end of the door expander 44.

Figure 27:
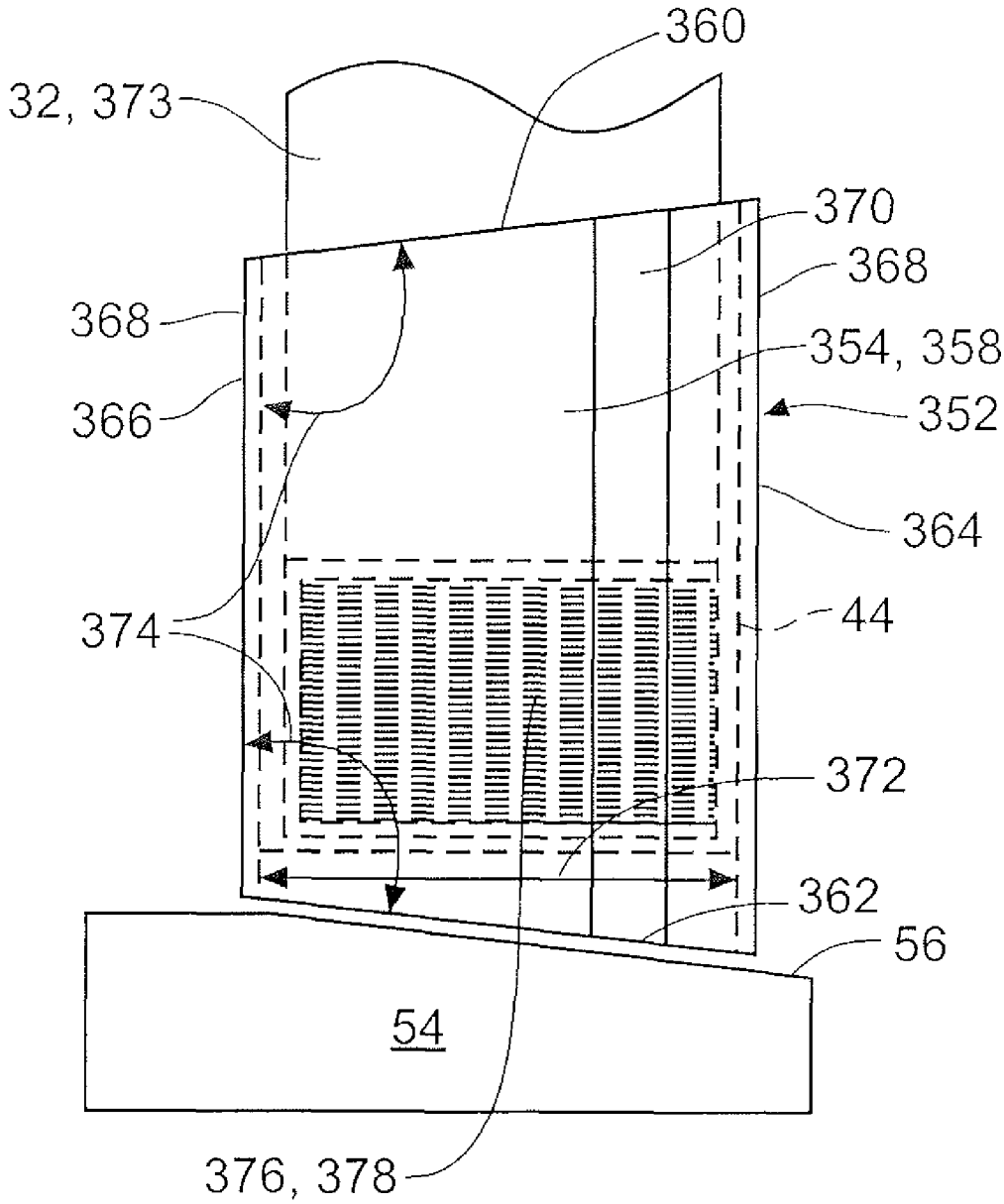
FIG. 27 is an end view of a guard assembly mounted to a door in an embodiment of the invention.

Referring to FIG. 27, the top end 360 and/or the bottom end 362 of the guard assembly 352 may be formed or cut at an angle 374 relative to the front edge 364. The angle 374 may correspond to the inclined surface 56 of the sill 54.

In assembly, the guard assembly 352 may be mounted to one or both edges of the door 32 for engagement with either the hinge side or the latch side z-bar or z-bar assembly. Coverage of the guard assembly 352 may be along the entire vertical edge or edges 373 of the door 32 or just a portion thereof such as the expander 44. In an alternative configuration, the rails may be spaced to fit both inside the door expander 44 while capping the vertical edge 373 of the door 32. The guard assembly 352 may be placed over the end of the door expander 44 and adjusted to a position appropriate to provide contact or near contact with the top of the sill 54 when the exterior door 32 is closed. The guard assembly 352 may also be mounted to the end of the door expander 44 with glue, or with fasteners (not depicted), or by other means available to the artisan.

To accommodate mounting the guard assembly 352 with fasteners, the one or more rail portions 368 may extend over one or more of the faces of the door expander 44 or the door 32 at a distance sufficient to accommodate the head of a fastener (not depicted). The various means of mounting the guard assembly 352 to the door expander 44 herein disclosed or otherwise known to the artisan may be utilized separately or in combination.

For embodiments that include the angle 374 on the top and/or the bottom end 360 and 362, the guard assembly 352 may be installed without need for cutting the guard assembly 352. When both ends 360 and 362 have inclines 370, the same guard assembly 352 may be utilized on either the hinge side or the latch side of the exterior door 32.

Functionally, the shield portion 370 may engage or nearly engage the z-bar 38 when the door 32 is in a closed position. The guard assembly 352 enables the z-bar 38 to be dimensioned shorter than the length of the door jamb 52, and bridges the gap 57 (e.g. FIG. 2) between the z-bar 38 and the door jamb 52. The guard assembly 352 provides a barrier at the end of the door expander 44 that inhibits collection of matter such as dirt, sand and salts that may corrode the door expander 44 over time. The guard assembly 352 may also enhance the thermal insulative quality of the exterior door assembly in at least two ways. First, the guard assembly 352 inhibits the flow of air through the door expander 44, thereby providing a dead air pocket 376 within the door expander 44 and enhancing the thermal resistance of the door assembly 30; the dead air pocket 376 may alternatively be filled with an insulation 378 that is contained when guard assemblies 352 are utilized on both ends of the door expander 44. Second, the guard assembly 352 serves as an additional barrier for impeding air flow and inclement elements such as rain and snow into a gap 380 between the door 32 and the z-bar assembly 36 (FIG. 26C), particularly when the guard assembly 352 extends over an appreciable length of the vertical edge 373 of the door 32.

The guard assembly 352 may be utilized without the z-bar extension member 40, as depicted in FIGS. 26A through 26C, or in conjunction with the z-bar extension member 40 to provide the additional barrier characteristics outlined above.

The guard assembly 352 may be fabricated from a resilient material, such as metal or high density plastic, or from a more compliant material such as a rubber or silicone, or from a combination of resilient and compliant materials. Additionally, the shield portion 370 may be fitted with weather stripping or other suitable material to provide further insulative characteristics to the door assembly 30 and to compensate for dimensional intolerances that may occur in fabrication and installation.

In another embodiment, the shield portion 370 may be connected to the base portion 354 of the guard assembly 352 through a hinge portion (not depicted). The hinge portion may be a separate member, such as a spring-loaded pivot pin that connects the base and shield portions 354 and 370, or a living hinge that is integral to the base and shield portions 354 and 370, or by other hinging techniques known to the artisan. The hinge concept can provide compliance between the shield portion 370 and the z-bar 38 that compensates for dimensional intolerances that may occur in fabrication and installation, or which develop over time. The hinge concept may find enhanced utility in conjunction with hinge-side z-bars; the tight radius of rotation of the shield portion 370 about the z-bar 38 may cause over extension of the flexing of the shield portion 370 relative to the base portion 354 of the guard assembly 352 whenever the exterior door 32 is partially or fully opened. Repeated over extension may lead to fatigue failure between the shield portion 370 and the base portion 354. The hinge member or hinge portion could be designed to reduce the fatigue of the components, thereby extending the life of the guard assembly 352.

As previously discussed, a z-bar may be mounted to the header of a door casing, defining an upper gap between the z-bar and the header (not depicted). The guard assembly 352 may be utilized on the top edge of the door 32 to cover the upper gap when so configured.

References to relative terms such as upper and lower, front and back, left and right, or the like, are intended for convenience of description and are not contemplated to necessarily limit the present invention, or its components, to any specific orientation. All dimensions and aspect ratios depicted in the figures may vary with a potential design and the intended use of a specific embodiment of this invention without departing from the scope thereof.

Each of the additional figures and methods disclosed herein may be used separately, or in conjunction with other features and methods, to provide improved devices and methods for making and using the same. Therefore, combinations of features and methods disclosed herein may not be necessary to practice the invention in its broadest sense and are instead disclosed merely to particularly describe representative and preferred embodiments of the instant invention. Because various modifications, substitutions, and changes of this invention may be made by one of skill in the art without departing from the spirit thereof, the invention is not limited to the embodiments illustrated and described herein. Rather, the scope of the invention is to be determined by the appended claims and their equivalents.

What is claimed is:

1. An extended door assembly, comprising:

a z-bar member including a flange portion and a web portion separated by a barrel portion, said flange portion and said web portion being substantially orthogonal with respect to each other and being integral with said barrel portion, said z-bar member including an inward-facing surface and defining a first longitudinal axis and a cross-section perpendicular to said first longitudinal axis, said barrel portion defining a first arcuate segment of said cross-section having an inner radius that is substantially constant over a first arc having an angle that is greater than 135°;

a z-bar extension member including an extender flange portion and an extender web portion separated by an extender barrel portion, said extender flange portion and said extender web portion being substantially orthogonal with respect to each other and being integral with said extender barrel portion, said z-bar extension member including an outward-facing surface and defining a second longitudinal axis and an extender cross-section perpendicular to said second longitudinal axis, said extender barrel portion defining a second arcuate segment of said extender cross-section having an outer radius that is substantially constant over a second arc having an angle that is greater than 135°, said outer radius of said extender barrel portion of said z-bar extension member being less than said inner radius of said barrel portion of said z-bar member, wherein said z-bar extension member is engaged with said z-bar member so that the outward-facing surface of said extender barrel portion of said z-bar extender is in contact with the inward-facing surface of said barrel portion of said z-bar.

2. The door assembly of claim 1, wherein the outward-facing surface of said extender flange portion and said extender web portion of said z-bar extension member is in contact with the inward-facing surface of said z-bar member.

3. The door assembly of claim 1, further comprising a first base portion operatively coupled with said z-bar extension member, said first base portion being located on a first end of said z-bar extension member.

4. The door assembly of claim 3, wherein said base portion defines an obtuse angle relative to said longitudinal axis.

5. The door assembly of claim 1, wherein said first arc and said second arc have angles that are substantially 180°.

6. The door assembly of claim 1 further comprising a sill and a door.

7. The door assembly of claim 6 further comprising a door expander operatively coupled with said door and wherein said door is attached to said z-bar member with a hinge.

* * * * *